US009689201B2

(12) United States Patent
Riemelmoser et al.

(10) Patent No.: US 9,689,201 B2
(45) Date of Patent: Jun. 27, 2017

(54) SCREEN SYSTEM

(71) Applicant: ScreenAway Pty Ltd, Port Adelaide (AU)

(72) Inventors: John Riemelmoser, Salisbury Heights (AU); Concetta Antonina Riemelmoser, Salisbury Heights (AU); Kenneth Robert Doley, Salisbury Heights (AU); Mark Leslie Schmick, Salisbury Heights (AU)

(73) Assignee: SCREENAWAY PTY LTD (AU)

( * ) Notice: Subject to any disclaimer, the term of this patent is extended or adjusted under 35 U.S.C. 154(b) by 0 days.

(21) Appl. No.: 14/900,506

(22) PCT Filed: Jun. 27, 2014

(86) PCT No.: PCT/AU2014/000665
§ 371 (c)(1),
(2) Date: Dec. 21, 2015

(87) PCT Pub. No.: WO2014/205493
PCT Pub. Date: Dec. 31, 2014

(65) Prior Publication Data

US 2016/0369555 A1 Dec. 22, 2016

(30) Foreign Application Priority Data

Jun. 28, 2013 (AU) ..... 2013902396

(51) Int. Cl.
*E06B 3/32* (2006.01)
*E06B 9/54* (2006.01)
(Continued)

(52) U.S. Cl.
CPC ..... *E06B 9/54* (2013.01); *E06B 3/4609* (2013.01); *E06B 3/4618* (2013.01); *E06B 9/42* (2013.01);
(Continued)

(58) Field of Classification Search
CPC ..... E06B 9/54; E06B 2009/543; E06B 2009/527; E06B 9/522
(Continued)

(56) References Cited

U.S. PATENT DOCUMENTS 231,649 A * 8/1880 Burrell ..... E06B 9/54 160/99
740,033 A * 9/1903 McNamara ..... E06B 9/54 160/100
(Continued)

FOREIGN PATENT DOCUMENTS

AU WO 2016015084 A1 * 2/2016 ..... E06B 9/62
CN 2054478 U 3/1990
(Continued)

*Primary Examiner* — Katherine Mitchell
*Assistant Examiner* — Johnnie A Shablack
(74) *Attorney, Agent, or Firm* — Erickson Kernell IP, LLC

(57) ABSTRACT

A screen system for use with a sliding panel of a window or door is used to screen an opening as the sliding panel or door is opened. The screen is attached to the edge of the sliding panel adjacent the opening, and is wound onto a spindle. The spindle is rotatably mounted adjacent the screen opening around which the screen is wound so that the screen can be unwound from or wound onto the spindle. A cord is connected between the sliding panel and the spindle pulley via an idler pulley. In this arrangement the spindle is caused to rotate so as to wind the screen back onto the spindle as the sliding panel is slid towards the closed position. While the screen is wound off the spindle, the cord is wound onto the spindle pulley and vice versa. As the A tension adjustment arrangement can also be provided that is configured to adjust the tension in the cable as the screen is wound and unwound from the spindle due to the change in diameter of the cord around the spindle pulley.

10 Claims, 14 Drawing Sheets

(51) Int. Cl.

| | |
|---|---|
| ***E06B 9/42*** | (2006.01) |
| ***E06B 9/62*** | (2006.01) |
| ***E06B 3/46*** | (2006.01) |
| ***E06B 9/44*** | (2006.01) |
| ***E06B 9/58*** | (2006.01) |
| *E06B 9/60* | (2006.01) |
| *E06B 9/52* | (2006.01) |

(52) U.S. Cl.
CPC ..... *E06B 9/44* (2013.01); *E06B 9/58* (2013.01); *E06B 9/62* (2013.01); *E06B 9/60* (2013.01); *E06B 2009/527* (2013.01); *E06B 2009/543* (2013.01)

(58) Field of Classification Search
USPC ..... 160/98, 99, 100, 102
See application file for complete search history.

(56) References Cited

U.S. PATENT DOCUMENTS

| | | | | | |
|---|---|---|---|---|---|
| 901,067 | A * | 10/1908 | Casson | E06B 9/54 | 160/100 |
| 923,153 | A * | 6/1909 | Dennhardt | E06B 9/01 | 160/102 |
| 1,335,573 | A * | 3/1920 | Forcoz | E06B 9/54 | 160/27 |
| 1,780,461 | A * | 11/1930 | Byars | E06B 9/54 | 160/265 |
| 1,893,651 | A * | 1/1933 | Ray | E06B 9/54 | 160/21 |
| 3,911,990 | A * | 10/1975 | Hoover | E06B 9/54 | 160/100 |
| 4,359,081 | A * | 11/1982 | Brower | E06B 9/54 | 160/243 |
| 5,456,303 | A | 10/1995 | Horinouchi | | |
| 5,533,559 | A | 7/1996 | Judkins | | |
| 5,915,443 | A * | 6/1999 | Lindley, Jr. | E06B 9/54 | 160/100 |
| 6,082,432 | A * | 7/2000 | Kissinger | E06B 9/54 | 160/27 |
| 6,116,321 | A * | 9/2000 | Kavchar | B60J 1/16 | 160/100 |
| 6,209,610 | B1 * | 4/2001 | Davies | E05D 15/22 | 160/100 |
| 6,223,803 | B1 * | 5/2001 | Nielsen | E06B 9/42 | 160/100 |
| 6,463,983 | B1 * | 10/2002 | Lang | E06B 9/54 | 160/23.1 |
| 6,478,070 | B2 | 11/2002 | Poppema | | |
| 6,629,555 | B2 * | 10/2003 | DeBlock | E06B 9/54 | 160/275 |
| 6,679,002 | B2 * | 1/2004 | Davies | G09F 23/06 | 49/322 |
| 6,814,127 | B2 * | 11/2004 | Tagtow | E06B 9/54 | 160/273.1 |
| 7,210,513 | B2 * | 5/2007 | Goldenberg | E06B 9/54 | 160/296 |
| 7,487,816 | B2 * | 2/2009 | Moriya | E06B 9/54 | 160/23.1 |
| 7,669,634 | B2 * | 3/2010 | Sugiyama | E06B 9/54 | 160/206 |
| 8,011,413 | B2 | 9/2011 | Poppema | | |
| 8,056,601 | B2 | 11/2011 | Kirby et al. | | |
| 8,191,601 | B2 * | 6/2012 | Okachi | E06B 9/54 | 160/122 |
| 8,439,098 | B1 * | 5/2013 | Jones | E06B 9/54 | 160/116 |
| 8,631,850 | B2 * | 1/2014 | Fayette | E06B 3/4415 | 160/100 |
| 8,656,978 | B2 * | 2/2014 | Goldenberg | E06B 9/52 | 160/122 |
| 2001/0042346 | A1 | 11/2001 | Brioschi | | |
| 2004/0154753 | A1 | 8/2004 | Tagtow et al. | | |
| 2005/0051280 | A1 * | 3/2005 | Thomas | E06B 9/54 | 160/98 |
| 2005/0161175 | A1 * | 7/2005 | Tussinger | E06B 9/62 | 160/265 |
| 2005/0257899 | A1 * | 11/2005 | Lee | B60P 3/36 | 160/98 |
| 2006/0225847 | A1 * | 10/2006 | Davies | E05D 15/22 | 160/201 |
| 2007/0227676 | A1 * | 10/2007 | Legay | E06B 7/03 | 160/102 |
| 2008/0163988 | A1 | 7/2008 | Hicks et al. | | |

FOREIGN PATENT DOCUMENTS

| | | | | |
|---|---|---|---|---|
| CN | 101021141 | A | 8/2007 | |
| CN | WO 2010034156 | A1 * | 4/2010 | E06B 9/54 |
| GB | 433498 | A | 8/1935 | |
| GB | 1188690 | A | 4/1970 | |
| TW | 201122208 | A | 7/2011 | |

* cited by examiner

SCREEN SYSTEM

PRIORITY DOCUMENTS

The present application claims priority from Australian Provisional Patent Application No. 2013902396 titled "An Improved Screen System" and filed on 28 Jun. 2013; the entire content of which is hereby incorporated by reference.

TECHNICAL FIELD

The present invention relates to a screen system used with opening panels and in particular to providing a moving screen to screen an opening as the panel is moved from a closed position to an open position.

BACKGROUND

It is a common requirement to provide a screen in relation to doors or windows. For example, in the case of a window, there may be provided a sliding window panel which is used to open the window. Conventionally, a screen is used to prevent ingress of insects or debris while at the same time providing ventilation. Also, screens are generally open mesh which also provides visibility through the screen.

In the case of doors, it is common to use a second door as the screen.

One disadvantage in the case of windows is that existing screen systems cover one half or a number of portions of the window. They will have permanently installed screens so that a portion of the window provides a clear view while for the remainder of the window, the user will have to look through the window and screen. It would be much more desirable to have simply glass unobstructed by any screens.

Also, the screens are normally provided in a frame which is then mounted to the window. This then results to restricted access to the window for the purpose of cleaning or other maintenance.

Sliding doors are common, but in these cases it is necessary to have both a sliding door with glass and a second sliding door with the screen. In certain circumstances it could be desirable for a screen to move into the opening as the door is opened There is thus a need to provide a screen system integrated with a window or door opening that eliminates some of these disadvantages, or at least provides a useful alternative to existing systems.

SUMMARY

According to a first aspect of the present invention, there is provided a screen system for use with a sliding panel of a window or door to screen an opening as the sliding panel or door is opened, the system comprising:

a frame, a sliding panel housed within the frame and comprising a first edge, wherein the sliding panel is slideable between a closed position and an open position to define an opening adjacent the first edge;

a roller assembly comprising:

a screen attached to the first edge of the sliding panel;

a spindle around which the screen is wound and rotatable mounted adjacent the first edge when the sliding panel is in the closed position so that the screen can be unwound from the spindle as the sliding panel is opened, and wound back onto the spindle as the sliding panel is closing; and a spindle rotation assembly for rotating the spindle;

an idler pulley located within the frame housing;

at least one operative means connected between the sliding panel and the spindle rotation assembly via the idler pulley, that causes the spindle to rotate so as to wind the screen back onto the spindle as the sliding panel is closing.

In one form, the screen system further comprises:

a tension adjustment arrangement comprising a mount housing that houses the idler pulley, a spring anchor securable with respect to the frame, and a spring secured between the mount housing and the spring anchor wherein the tension adjustment arrangement is configured to adjust the tension in the operative means as the screen is wound and unwound from the spindle.

In a further form, the frame comprises an upper slot, and the tension adjustment arrangement is located and secured in the upper slot.

In as further form, the upper slot comprises two side walls and the spring anchor is as block with tapered sides, and the tension adjustment further comprises a U shaped receiving block that is fastened to the spring anchor so that the tapered sides of the spring anchor force the walls of the a U shaped receiving block outwards to generate an the interference fit with the two side walls of the upper slot to secure the spring anchor in the upper slot.

In one form, the frame housing comprises a side frame member that substantially houses the roller assembly, and the side frame member has a removable cover, and the spindle comprises a rod portion onto which the screen is wound, and a retractable end assembly having an extended configuration and a retracted configuration, such that the length of the spindle in the retracted configuration is less than the length of the spindle in the extended configuration to allow removal of the spindle from the side frame member.

In a further form, the retractable assembly comprises a tube, a spring, a barrel and a plug, the tube comprising an open end for receiving the spring and barrel, and the barrel comprises a barrel lock aperture for receiving the plug, and a barrel projection, and the tube comprises a first cut out portion aligned with the barrel lock aperture, and second cut-out portion aligned with the barrel projection, such that when the plug is inserted through the first cut-out portion and into the barrel lock aperture, an end of the barrel extends beyond the second end of the tube and the retractable assembly is locked in the extended configuration, and when the plug is removed, the barrel can be at least partially retracted into the tube.

In one form, the spindle rotation assembly comprises a spindle pulley axially mounted to one end of the spindle.

In a further form, the spindle pulley comprises an axial aperture, and the spindle rotation assembly rotatably mounts the spindle and comprises a mounting block with a front face that faces the first edge of the sliding panel, a curved cut-out portion for receiving the spindle pulley, an axial projection located within the curved cut-out portion which in use projects into the axial aperture of the spindle pulley, and channel from the front face to the curved cut-out portion to guide the operative means onto the spindle pulley.

In a further form, the spindle rotation assembly further comprises a guide roller, and the channel comprises a straight portion and an angled portion, wherein the guide roller is located at the junction of the straight portion and angled portion and partially projects into the channel to guide the operative means as it is wound and unwound from the spindle pulley.

In a further form, the top surface of the mounting block comprises a flange and a channel, and the mounting block is supported by a top frame member of the frame that comprises a slot for receiving the flange and a pair of projections that are received in the channel.

In one form, the screen is removably attached to the first edge.

In one form, the frame comprises a first side frame member, a second side frame member, an upper frame member and a lower frame member, and each of the frame members are extrusions, wherein the upper frame member comprises an upper slot, and the lower frame member comprises a lower slot wherein the upper slot and lower slot are aligned and the sliding panel slides within the upper slot and the lower slot, and the roller assembly is substantially housed within the second side frame member and comprises a screen aperture through which the screen is unwound and wound onto the spindle, and a screen guide extending from the upper slot to the lower slot to guide the screen onto and off the spindle.

BRIEF DESCRIPTION OF DRAWINGS

Embodiments of the present invention will be discussed with reference to the accompanying drawings wherein.

In the following description, like reference characters designate like or corresponding parts throughout the figures.

DESCRIPTION OF EMBODIMENTS

Various embodiments of a screen system for integration into a frame of a window or door opening to allow the window or door opening to be covered when in an open position will now be described. The invention relates to a movable screen for use with as slideable panel wherein the screen moves to cover the opening as the panel is moved between an open and closed position. The screen may be attached with respect to the panel so that as the panel is moved from its closed to open position, the screen is drawn across the opening. The embodiments described below will be in relation to a window frame with a sliding window panel that slides over a fixed pane of glass. However, it will be realised that the invention will be suited to other applications such as sliding doors or in fact any situation where a panel is to be slid from a closed position to an open position where the opening is required to be covered by a screen. Further, the system could be further adapted for use with two sliding windows rather than a fixed and sliding window arrangement.

Figure 1:
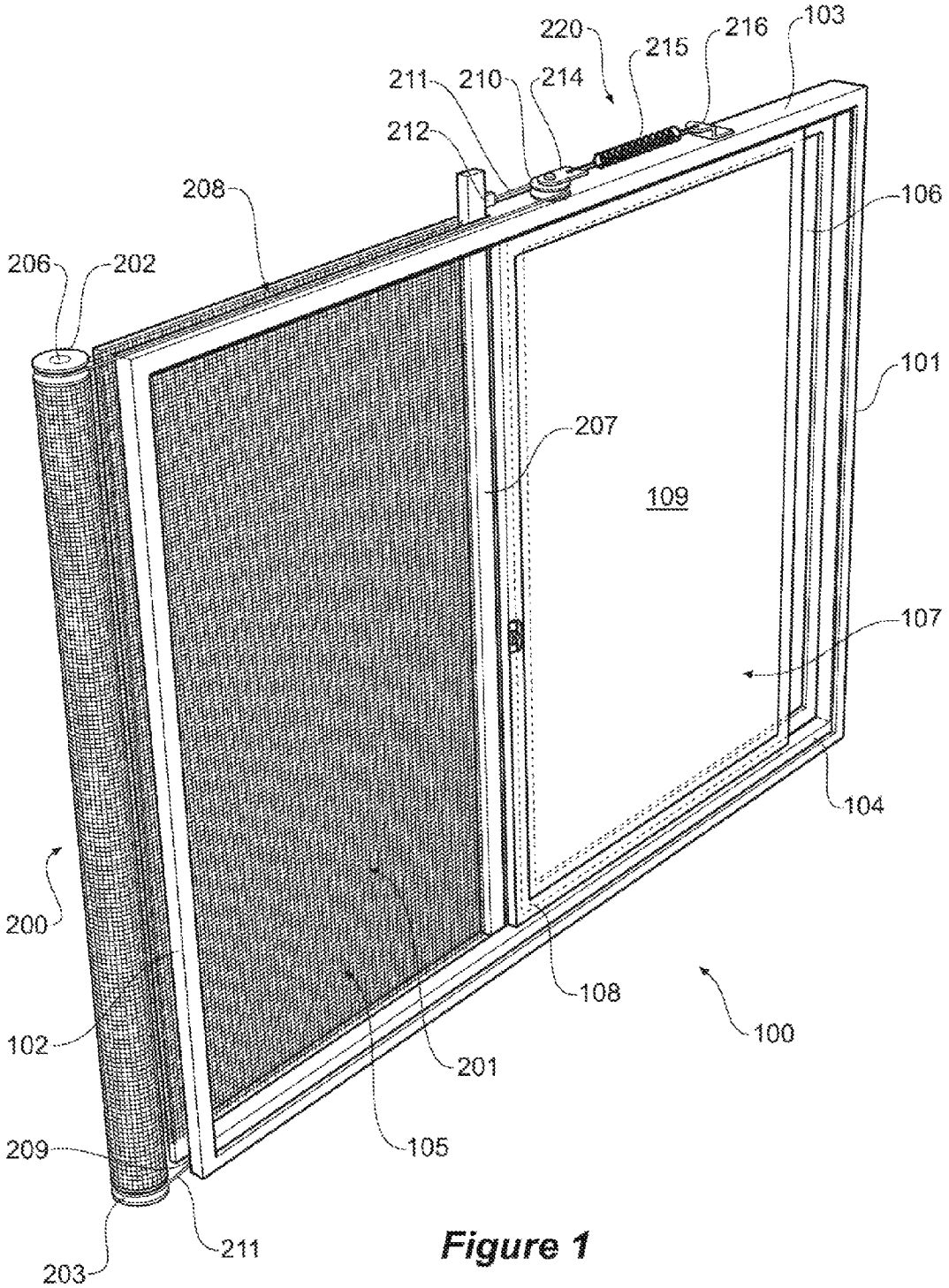
FIG. 1 shows an assembled view of a roller assembly used in conjunction with a slideable window panel according to an embodiment.

FIG. 1 shows a window frame assembly 100 that comprises a pair of side frame members—first side frame member 101 and second side frame member 102, and an upper frame member 103 and a lower frame member 104. These frame members 101, 102, 103 and 104 provide a rectangular window frame which can be mounted in an appropriate cavity within a building such as a house. One side of the window frame 100 has a permanently mounted first pane of glass 106. This first pane of glass 106 covers half of the window frame 100. Mounted within the window frame 100 for slideable movement between an open and closed position is a slideable window panel 107. The window panel 107 has a frame 108 and a pane of glass 109 within the frame 108.

As seen in FIG. 1, the window panel 107 has been slid to an open position. A roller assembly 200 is rotatably mounted adjacent the first side window frame member 101, being the side member adjacent the opening formed by movement of the window panel 107. The roller assembly 200 comprises a screen 201 wound on to a spindle 206. A spindle rotation assembly 230 (not shown in FIG. 1) is used to rotatably mount the spindle 206 with respect to the window frame 100. The end of the screen 201 is attached to a first edge of the window panel 207 which in this embodiment is a post extending above and below the horizontal frame members of the window panel. The screen may be fixed or secured to the first edge or removably attached to the first edge (e.g. using hooks or removable fasteners) so that a user can have the window fully open without a screen at all. A pair of slots, comprising an upper slot 208 and a lower slot 209, is formed in the respective upper and lower frame members extending from the adjacent the side member 102. The post 207 extends through the slots 208, 209 so that it is above and below lower frame members 103,104. Pulleys 202 and 203 are mounted to each end of the spindle 206. As will be described below, these upper and lower pulleys 202 and 203 are used to rotate the spindle 206.

An operative means 211 such as cord, cable, belt or other linkage is secured at the first end 212 or distal end with respect to the roller assembly, to the post 207. That is the operative means is connected between the panel and the roller assembly in such a way to cause the roller assembly to rotate as the panel is moved to a closed position to thereby wind the screen onto the spindle. It extends around an idler pulley 210 which reverses the direction of the cord and directs it back towards the roller assembly where it wraps around and is attached to pulley 202. The idler pulley 210 is mounted using a tension adjustment arrangement 220 that comprises a spring 215 secured or anchored between a mount housing 214 and a spring anchor 216 which is securable to the frame. In this embodiment, the spring anchor comprises a bracket mounted to the upper frame member 103. The tension adjustment arrangement is arranged so that the idler pulley 210 applies tension to the cord 211, and compensates for a change in the tension of the cord as the cord is wound and unwound off pulley 202. An idler pulley 210 and associated spring 215 and cord 211 are also provided on the lower frame member 104 but are not shown in FIG. 1. In one embodiment, the spindle rotation assembly 230 includes is a mounting bracket secured with respect to the side member 102 and with apertures within which the spindle 206 is rotatably mounted. In another embodiment, the spindle rotation assembly 230 includes a bracket positioned underneath the pulley 202 so that it is between the pulley 202 and the screen 201.

In operation, with the window panel 107 fully closed the entire screen 201 is wound onto the spindle 206. As the window panel 107 is opened, screen 201 will be unwound from the roller assembly 200 so as to cover the opening. The window panel 107 will pull the screen 201 so as to unwind it from the roller assembly 200. At the same time, the pulleys 202 and 203 are rotated and upper and lower cords 211 are wound onto each of the pulleys 202 and 203. Note that in some embodiments, only a single upper or lower spindle rotation assembly, rather than both upper and lower spindle rotation assemblies, is used.

When the window panel 107 is closed, the cords 211 engage with, and cause the pulleys 202 and 203 to rotate and thereby rewind the screen 201 onto the roller assembly 200. The pulleys 202 and 203 have a diameter that results in the required rotation rate of the roller assembly 200 to roll the screen 201 onto the roller assembly 200 at the same rate at which the window panel 107 is being moved. In this way the screen 201 is itself retracted at the same rate as the window panel 107 is closed.

This mechanism thus has the advantage that extending and retracting the screen does not require any form of spring based tensioning arrangements to rewind the screen onto the roller assembly. Instead the arrangement guides an operative member around a pulley provided with a tension adjustment arrangement. This provides a smooth mechanism to extend and retract the screen. When the window panel is open and thus the screen is an extended position, closing the window is translated into a pulling action on the cord to unwind the cord off the first pulley, and this drives the rotation of the spindle to wind the screen back on. Conversely, opening the window to extend the screen rotates the spindle and pulley to wind the cord back onto the first pulley.

Figure 2:
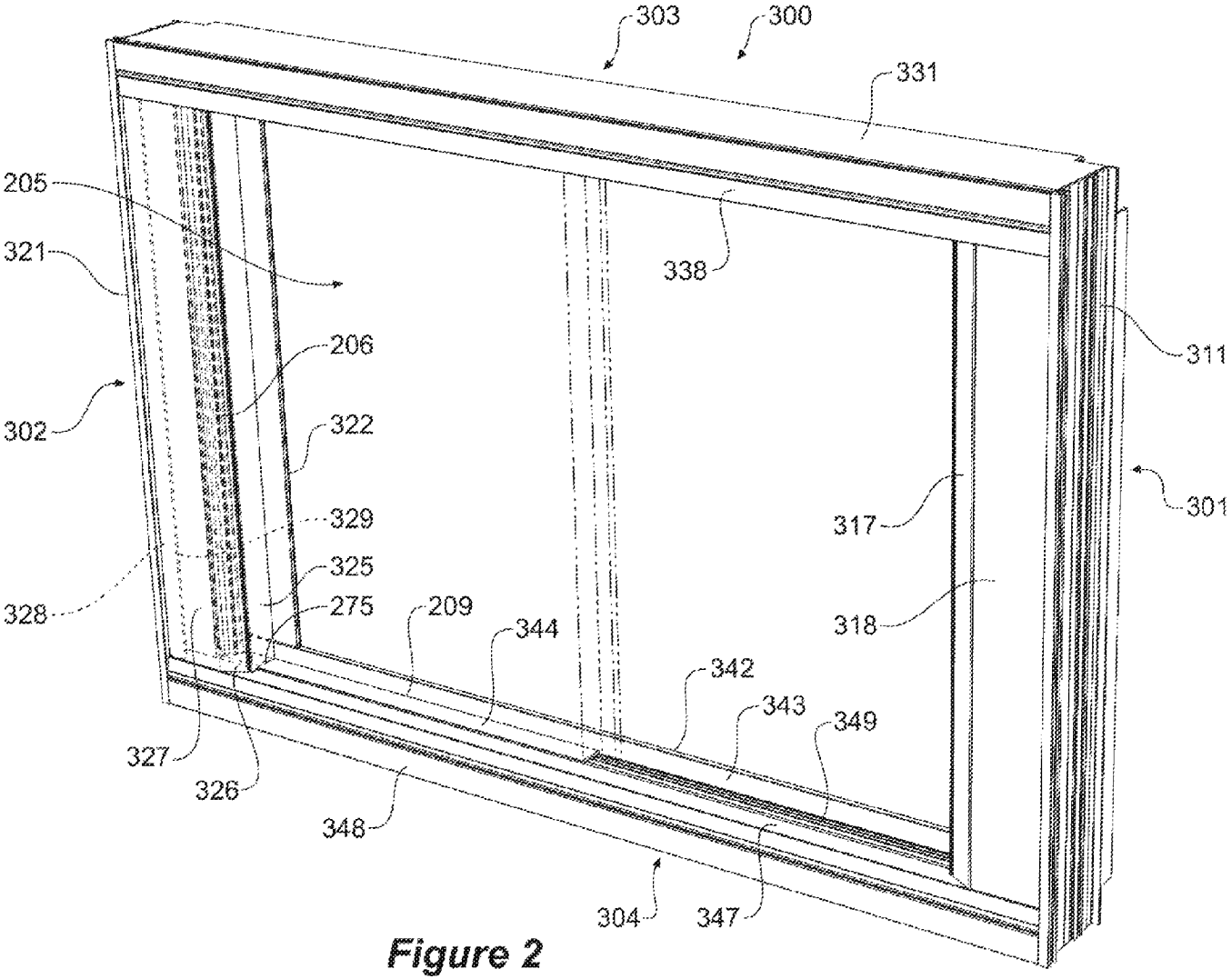
FIG. 2 shows a window frame support assembly according to an embodiment.

FIG. 2 shows another embodiment of a window frame 300, comprised of a first side frame member 301, a second side frame member 302, an upper frame member 303 and a lower frame member 304 which support the fixed pane of glass 106 and slideable window panel 107 (omitted for clarity) and house the roller assembly and related components. The terms upper and lower are with respect to the view shown in FIG. 2, and thus the upper frame member and lower frame member could equivalently be referred to as third and fourth frame members. In this embodiment each of the window frame members are extruded frame members, and may be formed of single extruded sections, or assembled from several extruded components. In this embodiment the roller assembly including the spindle 206 and screen is housed within the second side frame member 302 behind a removable side frame member 308. The slideable window panel 107 slides laterally within a first lower channel 209, with the slideable window panel being in a closed position when on the left and the fixed pane of glass 106 is located in a second lower channel portion 349 (on the right in the view shown in FIG. 2). The screen may be fixed or secured to the first edge or post of the slideable window panel 207 or removably attached to the first edge or post (e.g. using hooks or removable fasteners) so that a user can have the window fully open. When the screen is detached it may be secure to attachment points provided on the housing to facilitate later reattachment to the slideable window panel 107.

In this embodiment, the view of the window frame is from the outside, so that the user can slide the screen from the inside, and access to the roller assembly by removal of the movable side frame member 308 is via the outside. However, it will be understood that this arrangement could be reversed (i.e. the view could be from the inside, allowing inside access to the roller assembly) and the only substantial change would be movement of a handle 307 for sliding the slideable panel and screen. In this embodiment, the window frame members are configured to receive the fixed pane of glass 106, and a slideable window panel 107 comprising a pane of glass 109 and frame 108. In other embodiments, the window frame 100 shown in FIG. 1 could be mounted within the window frame member 300 shown in FIG. 2.

Figure 3A:
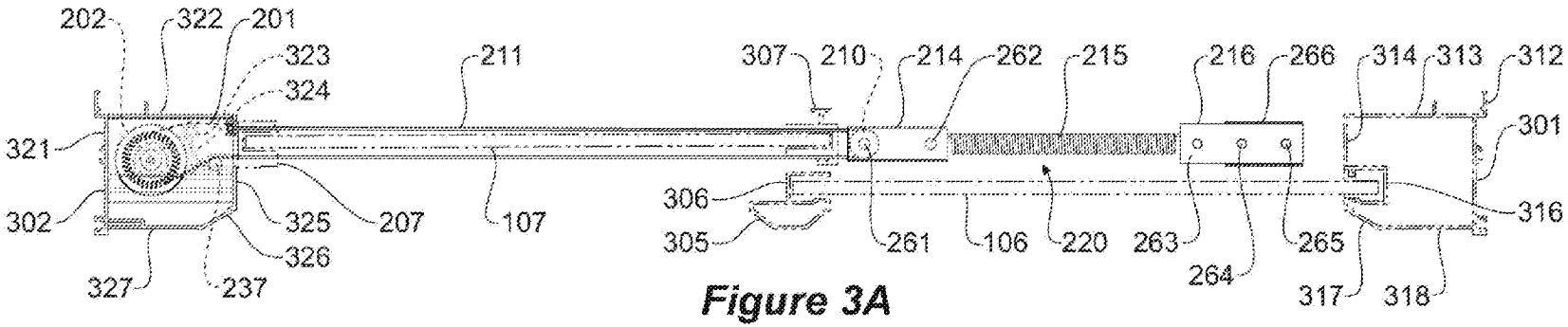
FIG. 3 to shows a top view of the roller assembly and slideable window panel in a closed state according to an embodiment.
FIG. 3B shows the window panel shown in FIG. 3A in an opening state illustrating extension of the screen from the roller assembly.
FIG. 3C shows the window panel shown in FIG. 3A in a fully open state illustrating full extension of the screen from the roller assembly.
Figure 3B:
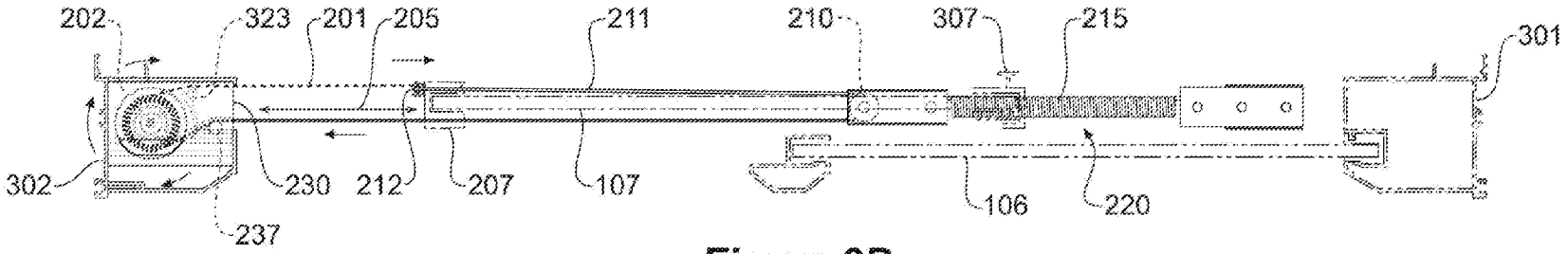
Figure 3C:
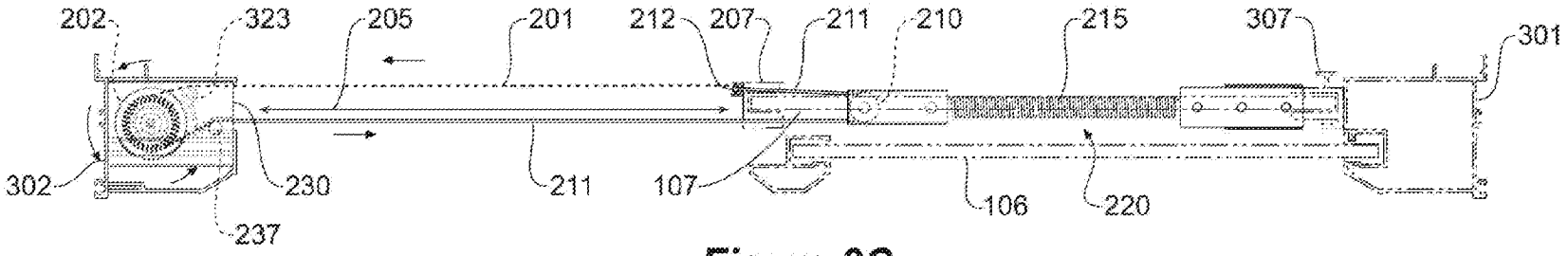

FIGS. 3A, 3B, and 3C shows a top view of the roller assembly and slideable window panel in a closed state, opening state and fully open state, respectively, of the window frame illustrated in FIG. 2 with the upper frame 103 removed. Referring to FIG. 3A, the fixed pane of glass 106 is mounted between the first side frame member 301 and a central member 305, in respective pane receiving channels 316 and 306. In FIG. 3A the window is in a closed position (or state) with the slideable window panel 107 extending across the window opening 105 from the central member 305 to the second side member 302. The roller assembly 200 is housed within the second side frame member 302. In this closed state, the screen 201 is fully wound onto the spindle 206, and only a small portion extends, within the housing of the second side frame member, from the spindle, past screen guide 323, to the edge of the window panel (i.e. post 207) where it is attached. From a top view the screen is attached to the post at the same attachment point for the first end 212 of the operative member, which in this embodiment is a cord 211.

In contrast to the screen which is fully retracted or fully wound onto the spindle in FIG. 3A, the operative member, which in this embodiment is a cord 211, is extended or unwound off the spindle to its maximum extent. In this embodiment, the cord 211 has one end 212 attached to an attachment point on the post 207 and extends toward the distal end of the slideable window panel (distal with respect to the roller assembly and spindle 206), where it passes around an idler pulley 210 of a tension adjustment arrangement 220. The idler pulley 210 redirects the cord back towards the second side frame member 302 where it passes around a guide roller 237 that guides the cord 211 onto (and thus around) the first pulley 202 of the spindle rotation assembly 230 where the second end of the cord is anchored or secured to the first pulley 202. The spindle rotation assembly 230 is shown in more detail in FIGS. 4, 5A, 5B and 6A. 6B, and 6C.

As shown in FIG. 3B, when the window is opening, for example by a user moving handle 307 located on the distal edge of the slideable window panel 107 towards the first side frame member 301, the screen 201 is pulled off the spindle 206 and extends across the opening 205. As the screen is extended and wound off the spindle, the spindle rotates anticlockwise as indicated by the arrows in FIG. 3B, and this drives rotation of the pulley 202 to retract the cord 211, and via idler pulley 210, wind it back onto the pulley 202.

FIG. 3C shows the slideable window 107 in the fully open position with the screen 201 fully unwound from the spindle, and extends across the window opening 205. As the screen is fully unwound the cord 211 is fully wound onto the pulley 202. If the window is not closed, for example by grasping handle 307 which is adjacent the first side frame member and moving it towards the second side frame member 302. As the cord 211 is fixed at one end 212 to an anchor point on the proximal edge of the slideable window panel 107, this movement pulls the anchored end 212 of the cord 211 towards the second side frame member, and via idler pulley 210, pulls the cord to unwind it off the pulley 202. This unwinding of pulley 202 thus drives clockwise rotation of the spindle 206 to wind the screen back onto the spindle 206.

During sliding of the window panel 107, the cord 211 is wound onto and off the spindle pulley 202. This results in a change in the diameter of the cord 211 wrapped around the spindle pulley 202 which can change the tension in the cord. This change in diameter can alternatively be viewed as a change in the length of the cord wrapped around the spindle pulley 202. Thus, to compensate for any change in tension in the cord 211 (or more generally the operative means used), the cord is passed through or around a tension adjustment arrangement 220. With reference to FIGS. 3A, 4, 8A and 8B, the tension adjustment arrangement 220 is located and secured in the upper slot 208 of the upper frame member 303, and comprises a proximally located mount housing 214 that is connected to a distally located spring anchor 216 via a spring 215. The mount housing 214 houses a proximally located idler pulley 210 which rotates around a shaft of a fastener 261, which has an axis substantially parallel, to the spindle axis, and a distally located first anchor point 262 which anchors the proximal end of the spring using a fastener 262. The distal end of the spring 215 is anchored to an anchor point 263 via a fastener located at the proximal end of the spring anchor 216. The spring anchor 216 comprises an approximately rectangular block with tapered side edges 267 268, with the width at the upper edge greater than the width at the lower edge (with respect to the window frame 300). The tapered block is received in a L1 shaped receiving block 266, and secured in place via fasteners 264 265. This is further illustrated in FIG. 8C that illustrated the tapered block of the spring anchor 216 and the receiving block 266 within the upper slot 208 of the upper frame member 303.

Figure 8A:
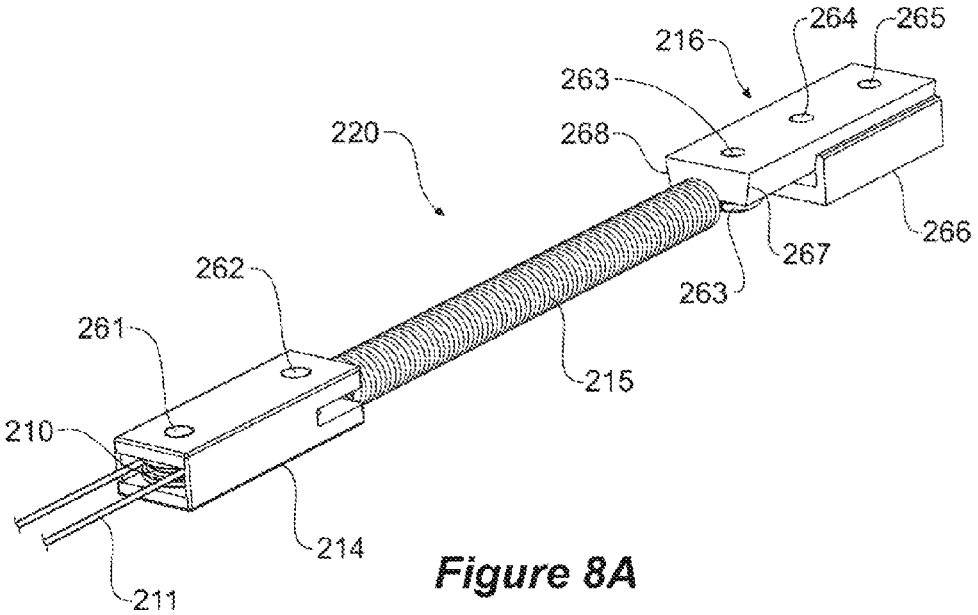
FIG. 8A is an isometric view of a tension adjuster arrangement according to an embodiment.
Figure 8B:
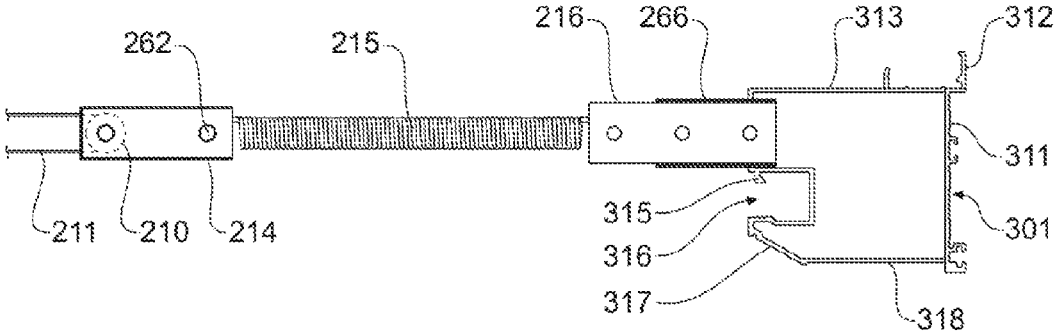
FIG. 8B is a top view of the tension adjuster arrangement and profile of the second side frame member according to an embodiment.
Figure 8C:
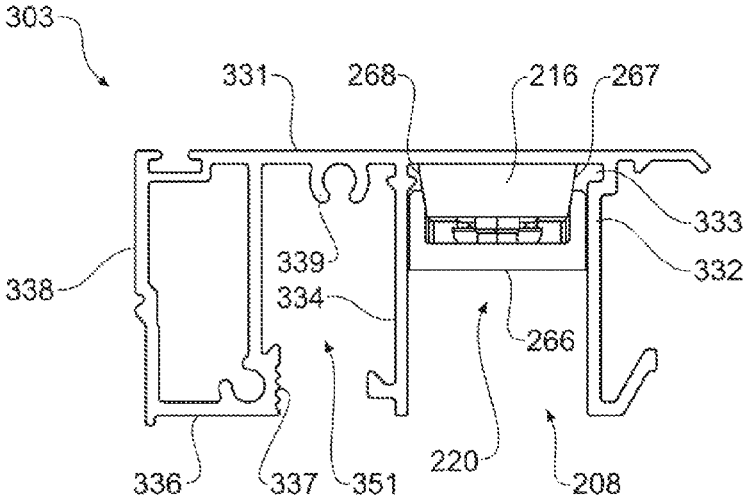
FIG. 8C is a side view of the tension adjuster arrangement and profile of the upper frame member according to an embodiment.

In this embodiment, the spring anchor 216 is seemed to the frame assembly 300 using an interference fit between the walls of the U shaped receiving block 266 and the walls of the upper slot 208 of the upper frame member 303. As illustrated in FIG. 8C, the spring anchor 216 rests against the lower or inner surface of the wall engaging panel within the upper slot 208. The U shaped receiving block 266 is then brought under the spring anchor 216 and fasteners in the form of screws 264 and 265 are used to screw the receiving block 266 to the spring anchor so that the tapered sides 267 268 of the spring anchor 216 force the walls of the U shaped receiving block outwards to generate an interference fit with the two side walls of the upper slot to secure the spring anchor in the upper slot. The use of an interference or frictional fit avoids the need to use adhesive or use fasteners such as screws or bolts that pass through or into the upper frame member, thus allowing the upper frame member to have an tin-interrupted exterior surface. However, in other embodiments, such arrangements could be used to secure the spring anchor 216 to the frame assembly 300.

As the tension in the cord changes as a result of the change in the diameter of the cord around the pulley 210, the length or extension of the spring 215 changes to compensate, resulting in lateral movement of the mount housing 214, and more relevantly, the position of the idler pulley 210 with respect to the spindle pulley 206. This compensation or accommodation of the change in tension occurs as the window is opened and closed, and facilitates smooth opening and closing operations whilst maintaining an acceptable amount of tension on the screen to prevent sagging.

In this embodiment the roller assembly 200 is adapted for removal from the frame. This is achieved through a combination of the design of both the spindle mounts and the second side frame member. As shown in FIGS. 6A to 6C, and FIGS. 7C and 7D, the second side frame member is constructed from two extrusions, in which the second extrusion is a removable side frame member 308 which can be removed to provide access to the removable roller assembly.

Figure 4:
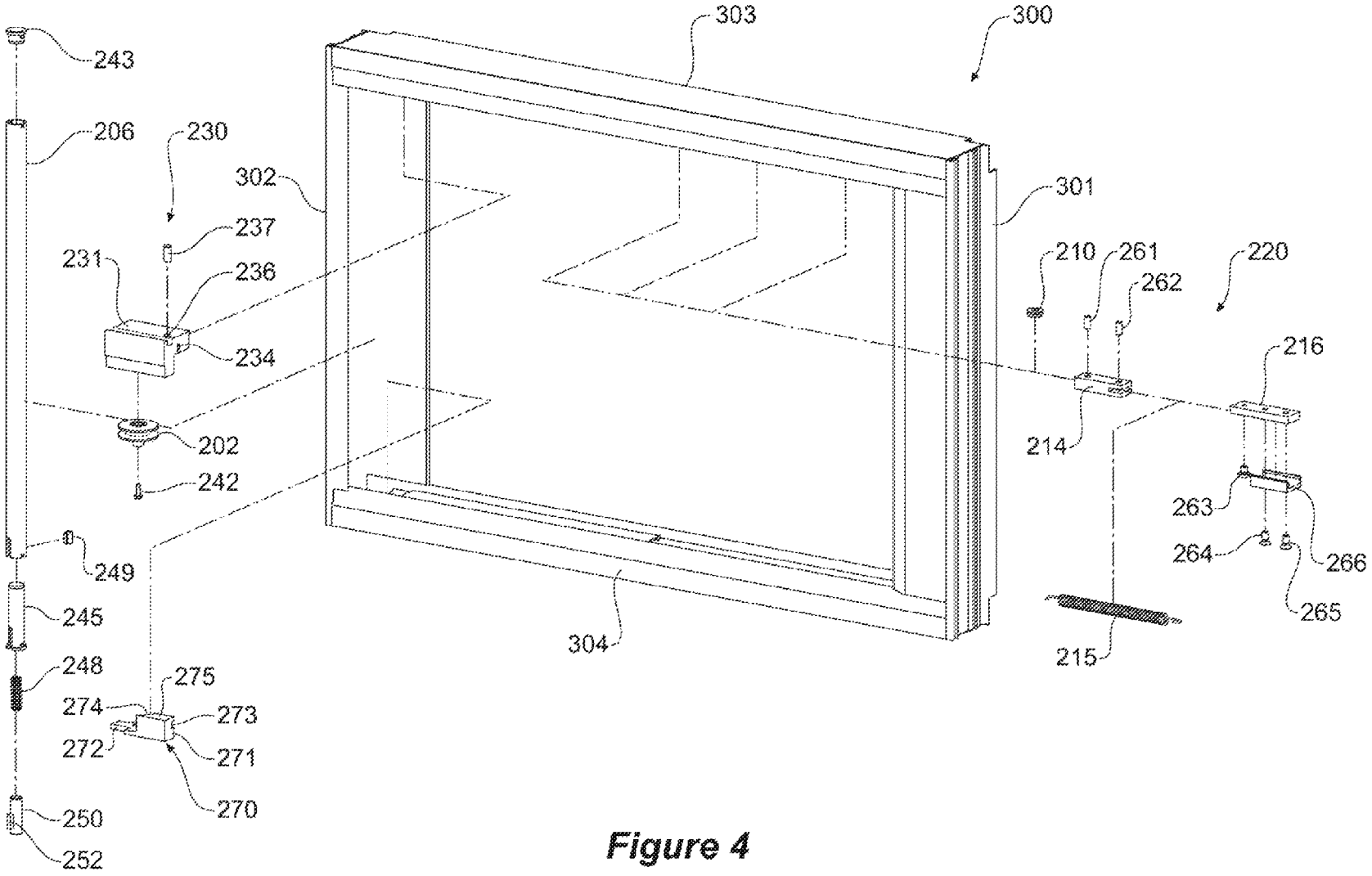
FIG. 4 shows the window frame of FIG. 2 further illustrating exploded view and the location of the roller assembly and tension adjuster assembly according to an embodiment.
Figure 5A:
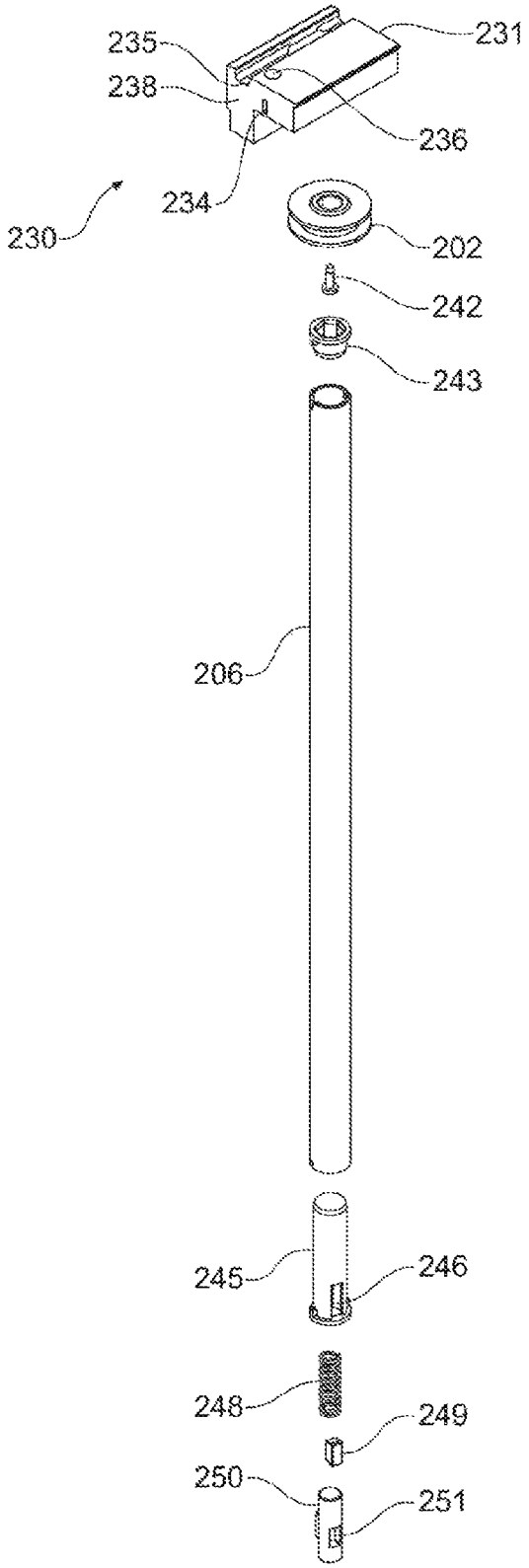
FIG. 5A is a first exploded perspective view of the roller assembly according to an embodiment.
Figure 5B:
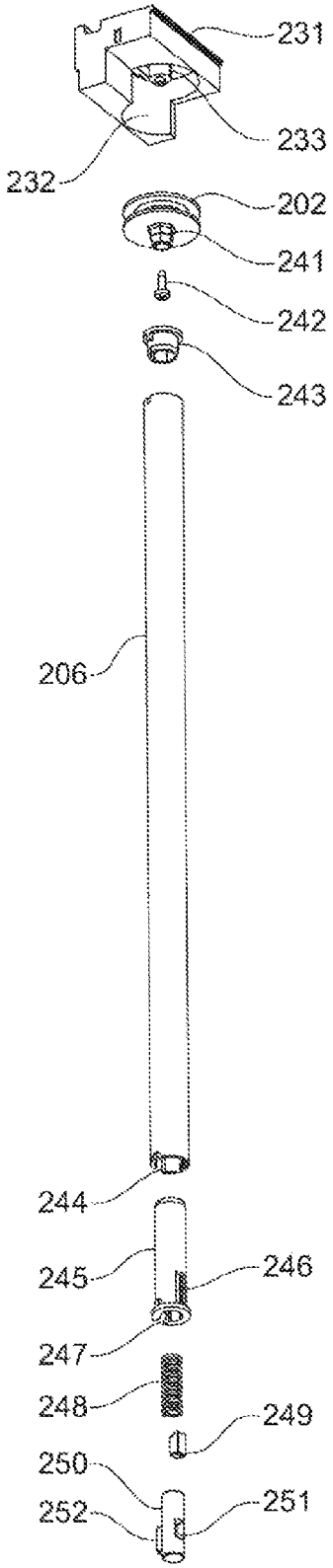
FIG. 5B is a second exploded perspective view of the roller assembly according to an embodiment.

The removable roller assembly 200 shown in FIG. 3 is shown in greater detail in FIGS. 4, 5A and 5B. An upper spindle rotation assembly 230 comprises an approximately L shaped mounting block 231 with a curved cut-out region 230 on the underside of the mounting block with a pulley axial projection 233 to receive the spindle pulley 202, which rotates about the pulley axial projection 233. A guide channel 239 for the cord 211 extends within the mounting block 231 from an aperture 234 on the front face 238 of the mounting block (when looking into the frame from the window opening) to the inner edge of the cut-out region so that the cord can be wound onto the pulley 202. That is the front face faces the first edge or post 207 of the slideable panel 107. The guide channel 239 comprises a straight portion (or section) followed by an angled portion or section) as shown as the dotted lines in FIG. 612. The top of the mounting block also comprises a cylindrical aperture 236 that extends down and intersects an edge of the guide channel 239 at the corner where the straight section means the angled section. The cylindrical aperture 236 receives a guide roller 237 that in use can rotate about a vertical axis. The guide roller 237 is located at the junction of the straight portion and angled portion and partially projects or extends into the guide channel 239 to guide the cord through the guide channel 239 and onto the spindle pulley 202 as it is wound and unwound from the spindle pulley The lower side of the spindle pulley 202 comprises a spigot projection 241 that receives a fastener 242 for securing the spindle pulley to the mounting block 231, by passing through an axial aperture in the pulley 202 and into a receiving aperture in the pulley axial projection 233. The spindle 206 is a tube which receives an upper end cap 243 into the upper end of the spindle 206. As can be seen in FIGS. 5A and 5B the upper end of the spindle comprises a cut-out portion to receive a side projection in the upper end cap 243 to lock it in place. The interior of the upper end cap 243 is shaped to mate with or engage with the spigot 241 on the spindle pulley 202.

To enable removability of the roller assembly the spindle 206 comprises a rod portion onto which the screen is wound, and a retractable end assembly having an extended configuration and a retracted configuration. The length of the spindle in the retracted configuration is less than the length of the spindle in the extended configuration to allow removal of the spindle from the side frame member. In this embodiment the lower end of the rod portion of the spindle 206 receives the retractable assembly that is comprised of a lower end insert in the form a tube 245, a spring 248, a plug 249 and a substantially barrel shaped piece 250.

The lower end of the spindle 206 comprises a first extended cut-out or slot 244. The lower end insert 245 is a tubular cylinder with a closed top end and open lower end which is inserted into the lower end of the spindle 206. The lower side wall of the cylinder comprise a first cut out or slot 246 and a second extended cut-out or slot 247, which in this case is opposite the first cut-out or slot 246 and in use is aligned with the extended cut out on the lower end of the spindle. To facilitate this alignment the lower end of the spindle also comprises a locking cut out that receives to locking projection on the lower end of the lower end insert 245. This allows alignment and prevents rotation of the lower end insert with respect to the spindle 206.

The lower end of the lower end insert 245 is open and receives a spring 248 and the barrel shaped piece 250. The barrel shaped piece 250 has a lock aperture 251 and a barrel projection 252. The barrel lock aperture 251 is aligned with the first cut-out 246 of the lower end insert 245 and is designed to receive a matching locking plug 249 that fits into and extends out of the barrel lock aperture 251. When the plug is inserted into the barrel, the lower end of the barrel extends beyond the second end of the tube 245 due to the action of the spring 248. The barrel projection 252 is aligned with the second extended cut-out 252 of the lower end insert 245 and the extended cut-out 244 of the lower end of the spindle 206. When the locking plug 249 is present, it passes through the first cut-out 246 and into the barrel 250, initially at a level below the top edge of the first cut-out 246. Thus the barrel 250 is able to be moved upwards (at least until the locking plug engages with and is stopped by the top edge of the first cut-out 246, and be at least partially retracted into the tube 245 effectively reducing the length of the spindle and allowing removal. Rotation of the barrel is prevented by barrel projection 252 that moves upward in the extended cut-outs 247 and 244. In this embodiment the spring 248 acts to push the barrel downwards to prevent retraction, and thus a tool such as a screw driver may be required to lever the barrel upwards, or to lever the locking plug, and thus the barrel, upwards and into the lower end insert 245 against the spring force. This arrangement has the advantage that the change in length of the spindle occurs in a portion that the screen is not wound onto, and thus the screen is unaffected. Other variations and arrangements could also be used to provide the change in length to provide the removability functionality.

The lower end of the spindle is mounted in a lower mounting arrangement 270 that comprises a block with a front face 271 and curved cut-out 274 leading to a base 272. Like the mounting block 231 of the upper spindle rotation assembly, the lower mounting arrangement comprises a cut out for receiving a lower or second spindle pulley 203 that rotates about an axial projection. The front face faces the first edge or post 207 of the sliding panel 107 and comprises a channel 273 for guiding a cord 211 onto the second pulley 203. The top of the pulley 203 is adapted to receive the lower end of the barrel 250 when it is in the extended position. For example the axial aperture of the pulley 203 may act as a receiving channel for the end of the barrel. Retraction of the barrel also retracts the barrel from the receiving channel.

Figure 6A:
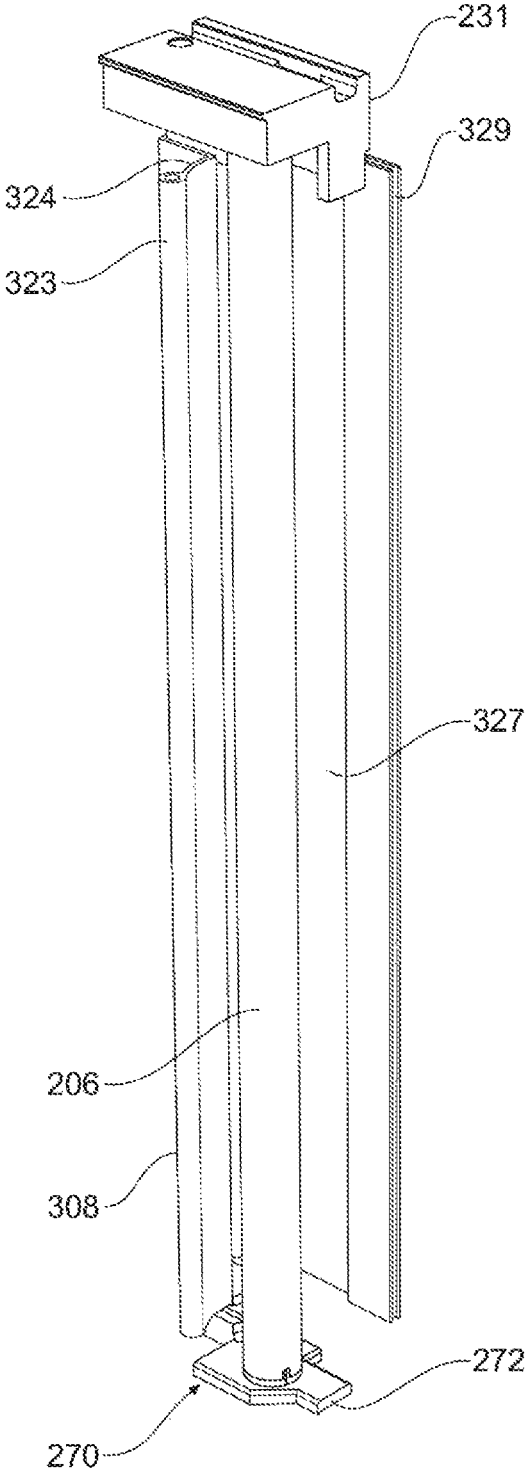
FIG. 6A is first perspective view of the roller assembly and a removable side frame member according to an embodiment.
Figure 6B:
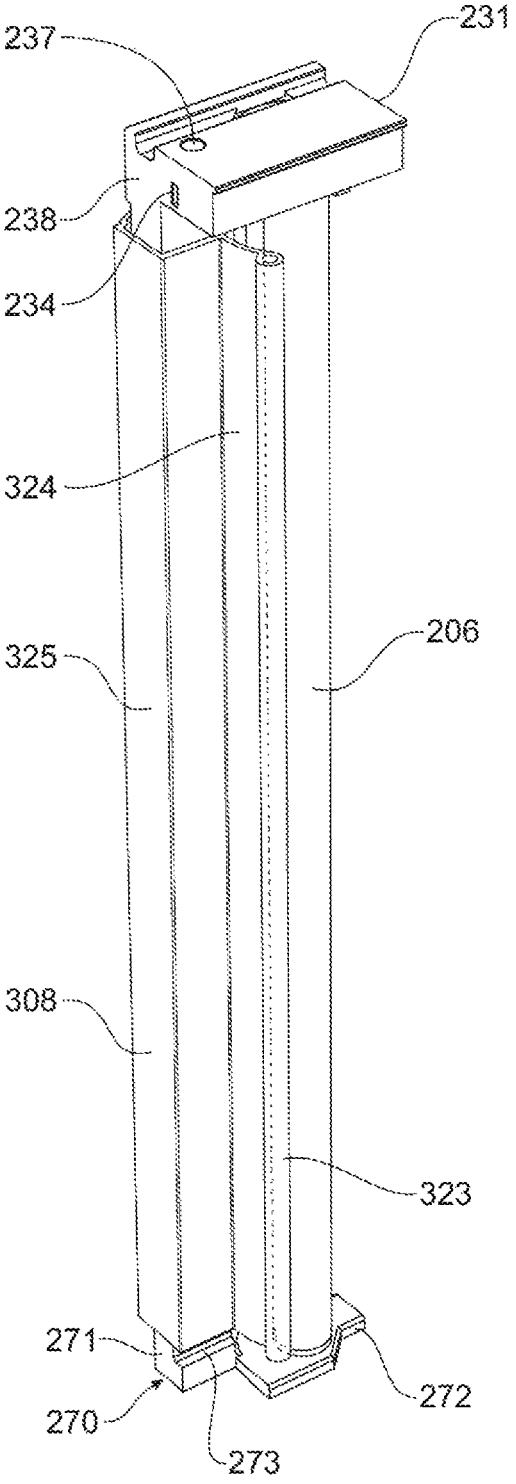
FIG. 6B is second perspective view of the roller assembly and a removable side frame member according to an embodiment.

FIGS. 6A and 6B are first and second perspective views of the roller assembly with the removable side frame member 308 of the side frame member 302. The removable side frame member 308 is an extrusion with a profile shown in FIG. 7D, and comprises a curved screen guide 323 attached to an L shaped arm portion 324. This is attached at the other end to an inner panel 325 portion (the most distal portion of the removable side frame member 308), and an inclined panel 326 and an exterior panel 327. The exterior panel ends with a slot 329. The lower mounting arrangement and profile of the second side frame member is shown in FIG. 7C. This illustrates the relative location of the guide roller 237 and screen guide 323.

Figure 6C:
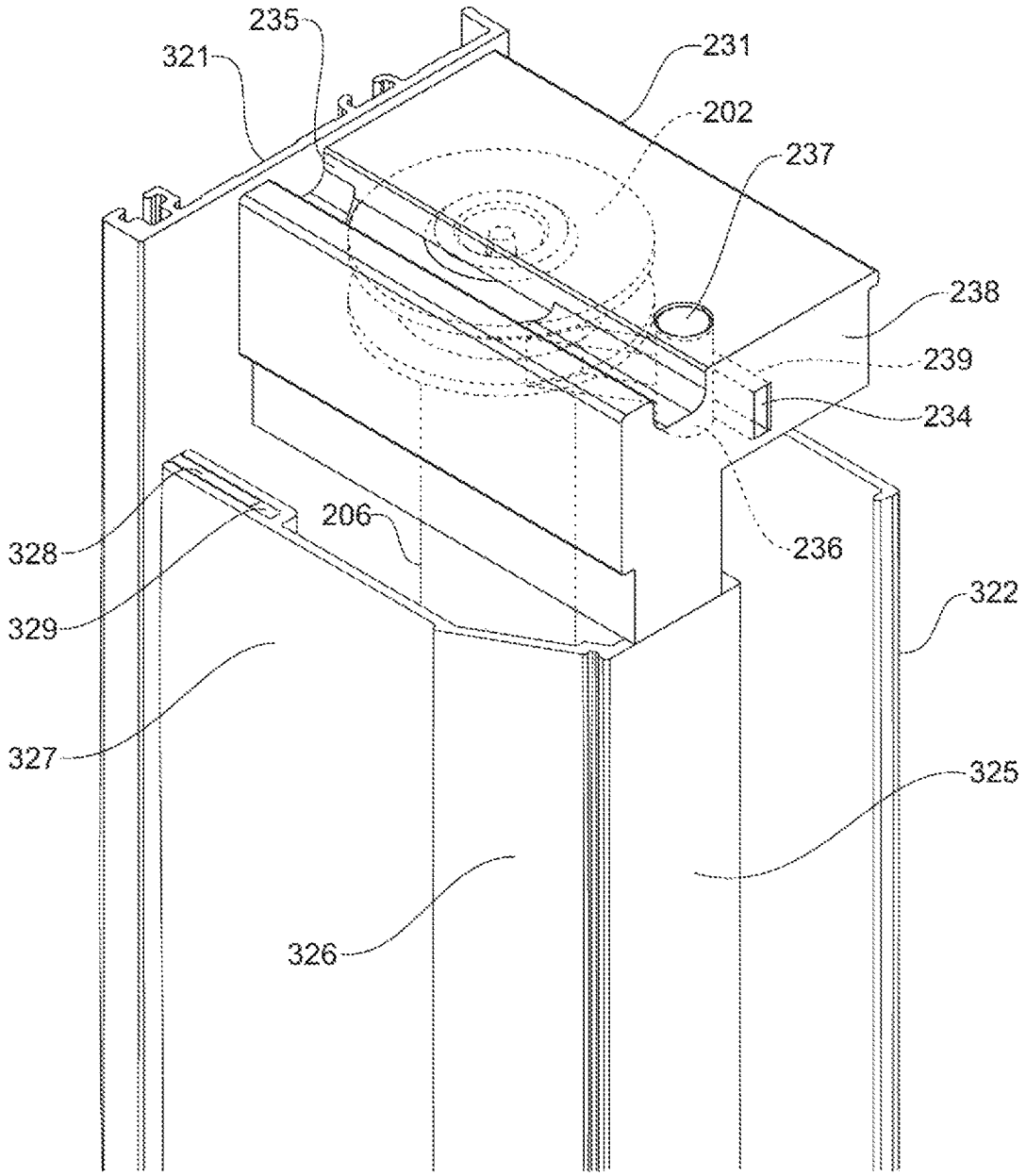
FIG. 6C is a close up view of the top of the roller assembly shown in FIG. 6A also showing engagement of the removable side frame member with second extrusion of the second side frame member according to an embodiment.

FIG. 6C is a close up view of the top of the roller assembly shown in FIG. 6A also showing engagement attic removable side frame member with second extrusion of the second side frame member 302. The mounting block 231 rests on the top edge of the inner panel 325 of the removable side frame member 208. Additionally, the top surface of the mounting block 231 comprises a flange (or projection) in the upper right hand top edge of the mounting block 231 which is received in a corresponding slot (or ridge) formed in the upper frame member 303 (sec FIG. 7B) to assist in supporting the mourning block 23L The top surface of the mounting block also includes an upper channel 235 that in use receives a pair of projections in the top frame member. The second extrusion comprises an outermost wall engaging portion 321 with an interior panel 322 on one side and a slot projection or fin 328 that fits into the slot 329 of the removable side frame member 308 to support and hold it in place.

Figure 7A:
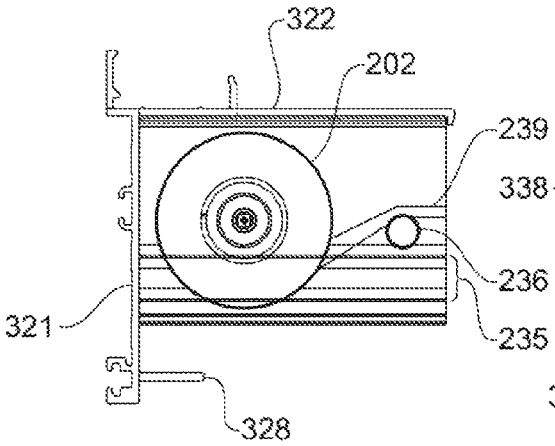
FIG. 7A is a top view of the spindle rotation assembly and the second extrusion of the second side frame member according to an embodiment.
Figure 7B:
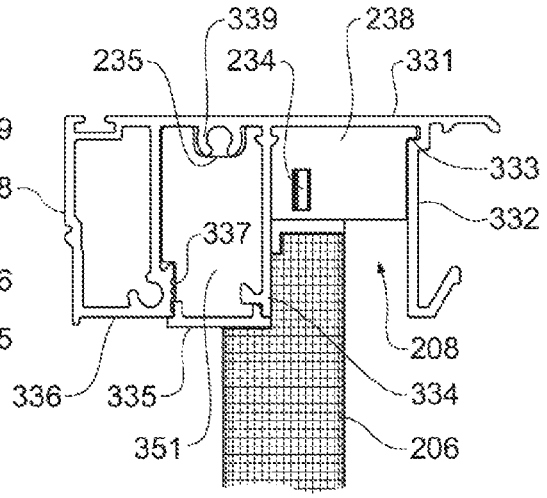
FIG. 7B is a side view of the spindle rotation assembly and profile of the upper frame member according to an embodiment.
Figure 7C:
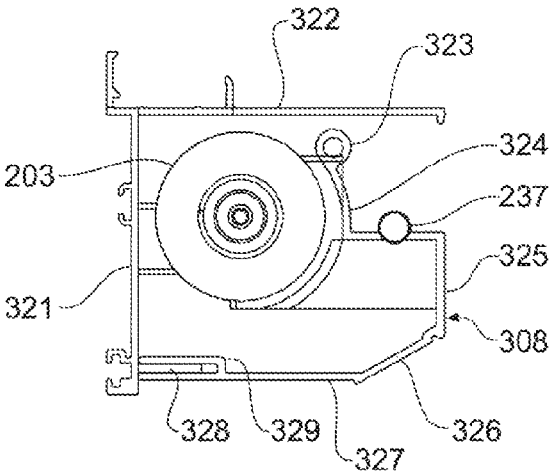
FIG. 7C is a bottom view of the lower mounting arrangement and profile of the second side frame member according to an embodiment.
Figure 7D:
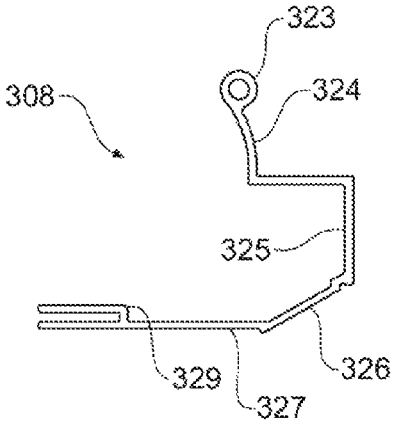
FIG. 7D is a top profile view of the a removable portion of the side frame member for accessing the roller assembly according to an embodiment.

The arrangement of the upper spindle rotation assembly 230 and the second extrusion of the second side frame member 308 is further shown in FIG. 7A. This further illustrates the cord channel 239, pulley 202, and upper channel 235, FIG. 7B is a side view of the spindle rotation assembly and profile of the upper frame member 303. The upper frame member 303 comprises a will engaging portion 331 from which downwardly extends an interior panel 332 and a central arm 334 which define the proximal end of the upper slot 208 (or channel) that the top edge of the slideable window panel 207 and cord 211 move within. FIG. 8C further illustrates the profile of the upper frame member 303, with the tension adjustment component 220 located in the upper slot 208. The interior panel 332 is formed with a slot 333 (or shoulder or ridge) near the base of the interior panel to receive the flange in the top edge of the mounting block 231, and extends downwards and ends with a hook at the lower end that is directed outwards and away from the upper slot 208 and towards the interior side of the window frame).

Parallel to the central arm 334 is another downward projection which ends with a ribbed portion 337 to form an upper window pane receiving channel 351 that is parallel to slot 208. The fixed window pane 106 only resides in the distal half of the window pane receiving channel 351, and thus the proximal half of the window pane receiving channel 351 is covered with a clipable panel 335. This clips into a projection on the central arm 334 and ribs formed on the vertical edge adjacent the start of a lower panel 336. The lower panel 336 then joins with the downwardly extending exterior panel 338.

The mounting block 231 is slid into the end of the upper frame member 303 and is supported in place via the slot 333 that supports a projection or flanged top edge of the mounting block 231. The mounting block 231 also includes an upper channel 235 to receive one or more projections 339 that extend down from the wall engaging panel 331. These are used to allow the second side frame member to be screwed to the upper frame member. The one or more projections may be a pair of projections to receive and engage with a screw passed through the wall of the second side frame member to fix the second side frame member to the upper frame member. Similarly, the other end of the pair of projections may receive a screw passing through the first side frame member to fix the first side frame member to the upper frame member. The size of the upper channel is selected to accommodate this expansion of the one or more projections 339. In some embodiments, the size of the channel could be selected so that the expansion of the one or more projections could lock into the walls of the upper channel to further support the mounting block 231.

Figure 9:
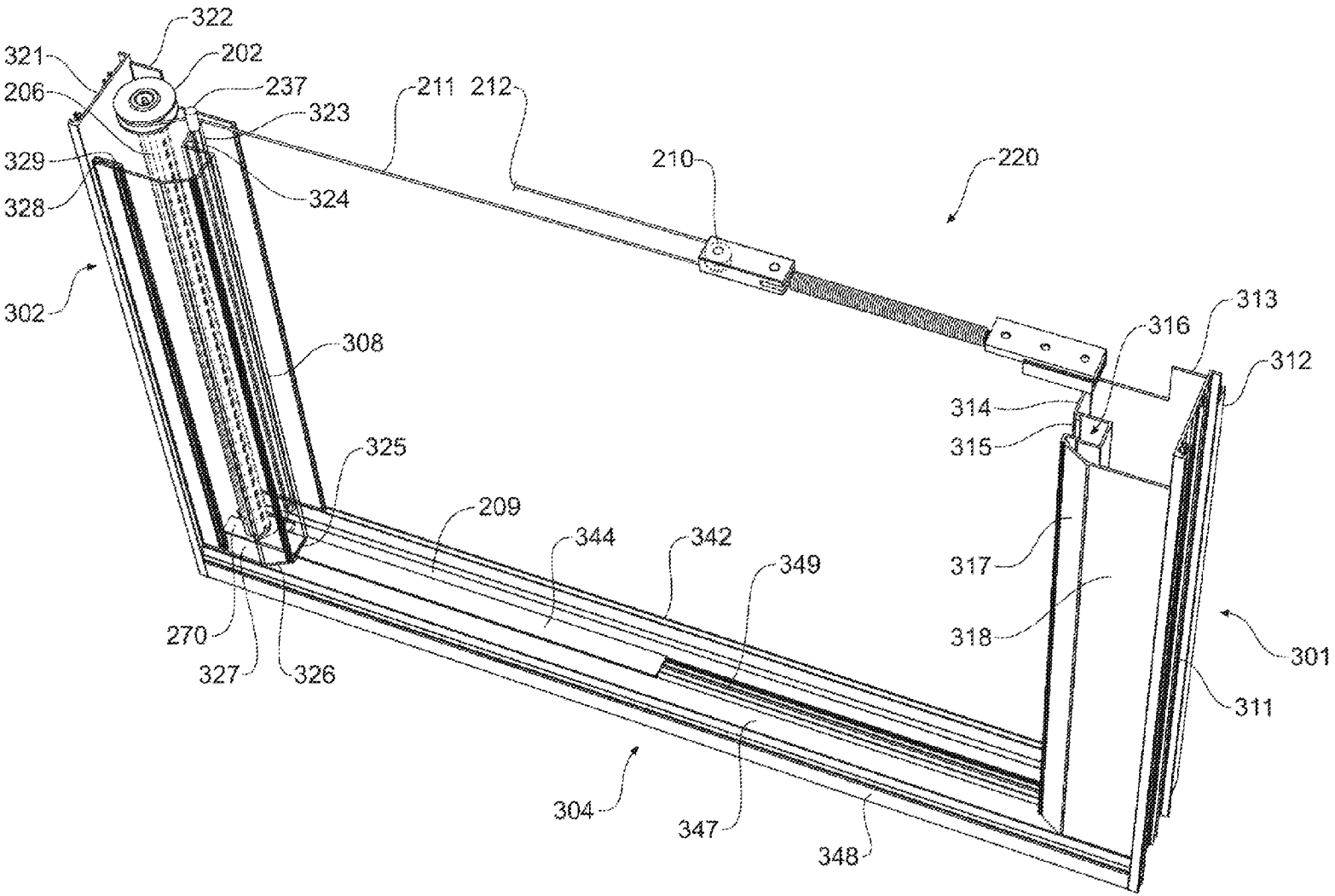
FIG. 9 is a perspective view of the window frame without the upper frame member according to an embodiment.
Figure 10A:
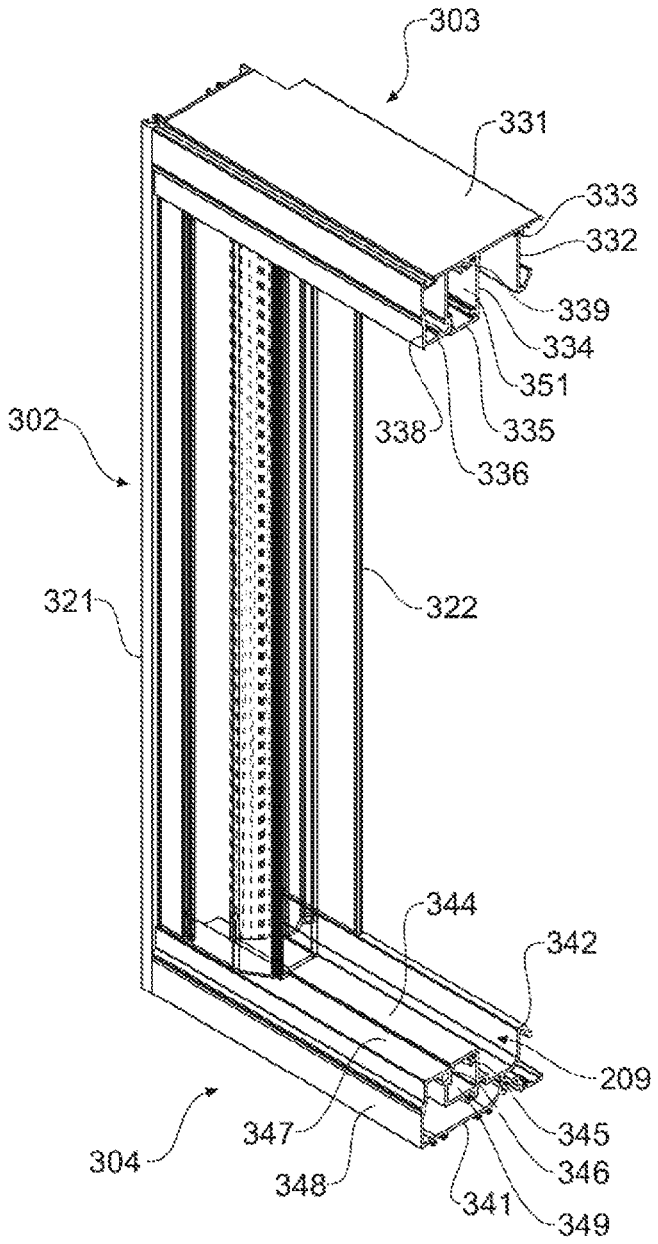
FIG. 10A is a perspective view of a cut away portion of the window frame illustrating cut away views of the upper frame member and lower frame member connected to the first side frame member according to an embodiment.
Figure 10B:
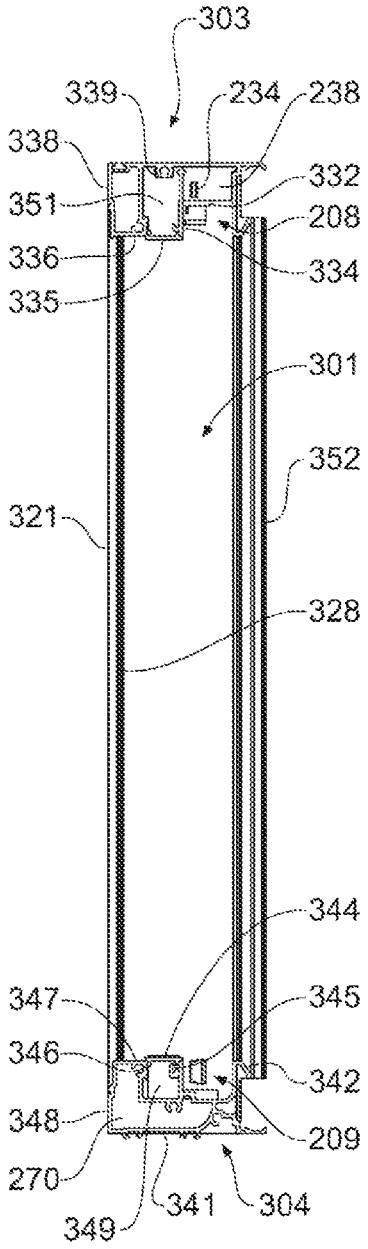
FIG. 10B is an end view of the cut away portion of the window frame shown in FIG. 10A.
Figure 10D:
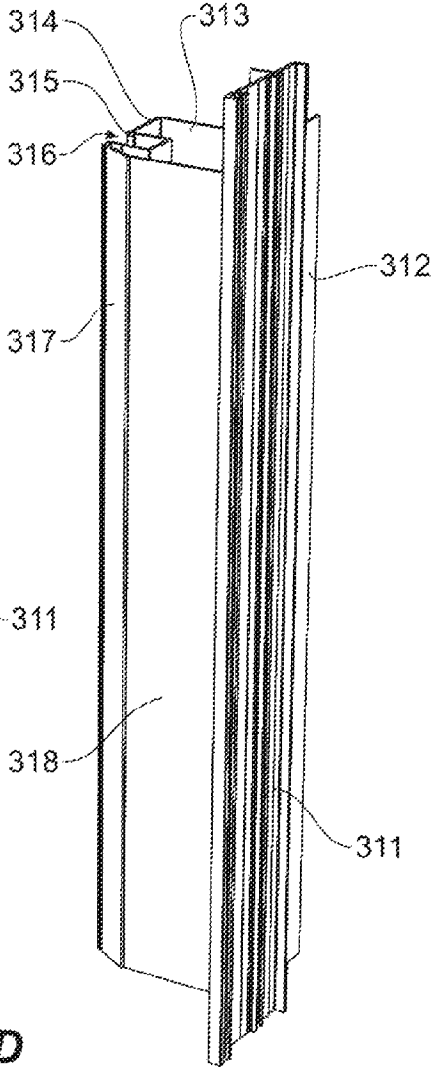
FIG. 10D is a perspective view of the second side frame member according to an embodiment.
Figure 10C:
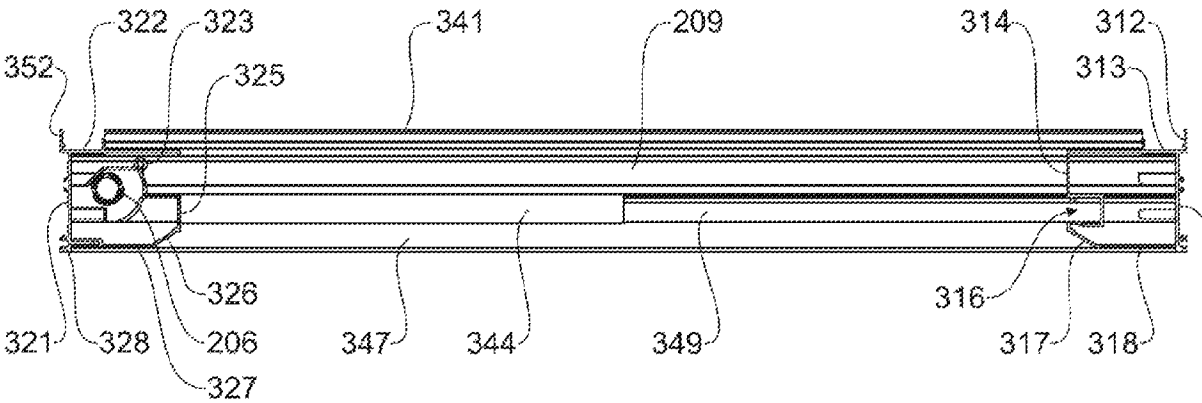
FIG. 10C is a top view of the lower frame member according to an embodiment.

FIGS. 9 and 10A to 10D further illustrate how the frame members are arranged with respect to each other to form the complete window frame. FIG. 9 is a perspective view of the window frame without the upper frame member. FIG. 10A is a perspective view of a cut away portion of the window frame illustrating cut away views of the upper frame member and lower frame member connected to the second side frame member. FIG. 10B is an end view of the cut away portion of the window frame shown in FIG. 10A. FIG. 10C is a top view of the lower frame member and FIG. 10D is a perspective view of the first side frame member.

The first side frame member 301 comprises a wall engaging panel 311 from which an interior panel 313 extends. A projection 312 directed towards the interior of the window frame, extends from the join line of the wall engaging portion and the interior panel 313. The interior panel extends inward towards the second frame member 302, and ends at one end of orthogonal inner panel 314. The inner panel 314 forms the surface that the slideable window panel 107 abuts against in the fully open position. The inner panel 314 is interrupted by pane receiving channel 316 that receives the fixed window pane 106. A pane engaging portion 315 extends into the pane receiving channel 316. On the other side of the pane receiving channel 316, an inclined panel 317 (similar to inclined panel 326) extends to meet the exterior panel 318 which extends back towards the wall engaging panel (and is orthogonal to).

The lower frame member 304 comprises a wall engaging panel 341 an interior panel that extends upwards from the wall engaging panel 341 and ends in an outwardly directed hook section similar to interior panel 322 of the upper frame member 303. The lower slot 209 (or channel) that the lower portion of the slideable window panel 107 slides within is formed by the interior panel 322 on one side, and a central arm 345 on the other. The central arm 345 then also forms one side of a window pane receiving channel 349 that is parallel to lower slot 209. The other side of this channel 349 then joins (orthogonally) to the top panel 347 which then joins exterior panel 348 that extends down and connects to the other end of the wall engaging portion 341. The fixed window pane 106 only resides in the distal half of the window pane receiving channel, and thus the proximal half of the window pane receiving channel 349 is covered with a clipable panel 344. This clips into a projection on the central arm 345 and ribs formed on the vertical edge adjacent the start of the top panel 347.

FIGS. 9 and 10A-10D illustrate the relative alignments of the various features of the window frame members. For example the inner panel 325 of the removable side frame member is aligned with the channel for the fixed glass pane 349 in the lower frame member, the pane receiving channel 316 of the first side frame member 301, the lower clipable panel 344 (which forms part of the sill) and the upper clipable panel 335. Similarly the interior panels 313, 322, 332 and 342 of the first and second side frame members and the upper and lower frame members (respectively) are all aligned (i.e. parallel). The hooked portions of the interior panels of the upper and lower frame members 332 and 342 are directed in the same direction and outward from the window frame (and in this context into the interior of the room). As shown in FIGS. 10C and 10D the projection 322 of the first side frame member, and the equivalent projection 352 on the second side frame member, extend into the interior to the same extent as the hooks.

The extrusions may be constructed of metals, including Aluminium, steel, and associated alloys, or other suitable materials such as plastics treated increase UV resistance or corrosions resistance. The window frame may be constructed in standard sizes, or be made to measure and shipped as a pre-assembled frame 300 to the building site. In this case, the installer installs the assembly into a cavity and seals the edges. The installer can then install the tension adjustment arrangement, or adjust the location as required. This can be performed by the installer partially unscrewing or removing fasteners 264 and 265 to allow the receiving block to at least partially disengage from the tapered edges 267 268, and thus allow the spring anchor's position within upper slot 208 to be adjusted. Once an appropriate location is selected (this may be a process of trial and error to find the location that enables smoothest opening and closing of the window), then the fasteners 264 and 265 are inserted or tightened to draw the receiving block towards tapered edges 267 268 to generate the interference fit between the spring anchor 216 and the walls of the upper slot 208. A similar procedure can be performed for the equivalent mechanism located in the lower slot (if present).

The slideable window panel 107 slides laterally within upper slot 208 and lower slot 209. However, it will be noted that the operative members or cord 211 also run in the upper and lower slot. Accordingly, the path of the operative member is configured so that the frame does not impair movement of the operative member 210 or tension adjustment arrangement 220. This can be achieved by fitting the window panel frame 108 with smooth feet or runner wheels extending both above and below the window panel frame to engage with the top of the upper slot 208 and the bottom of the lower slot 209. Additionally, the width of the feet is less than the width of the idler pulley 210 so that they run within the two sections of cord. Additionally or alternatively, the upper slot 208 and 209 may be fitted with removable covers that house the house the operative member 210 or tension adjustment arrangement 220, and upon which the feet or runner wheels move. In another embodiment, the window frame comprises a single pulley 208, operative member and tension adjustment arrangement located in the upper slot. In this embodiment the lower mounting arrangement 270 simply provides a seat for receiving the base of the spindle 207 (or barrel 250), and the window panel 107 runs along and is supported by the base of slot 208. In this case, the window panel 107 does not extend fully into the upper slot 208 to provide headspace for the operative member and tension adjustment arrangement.

Figure 11:
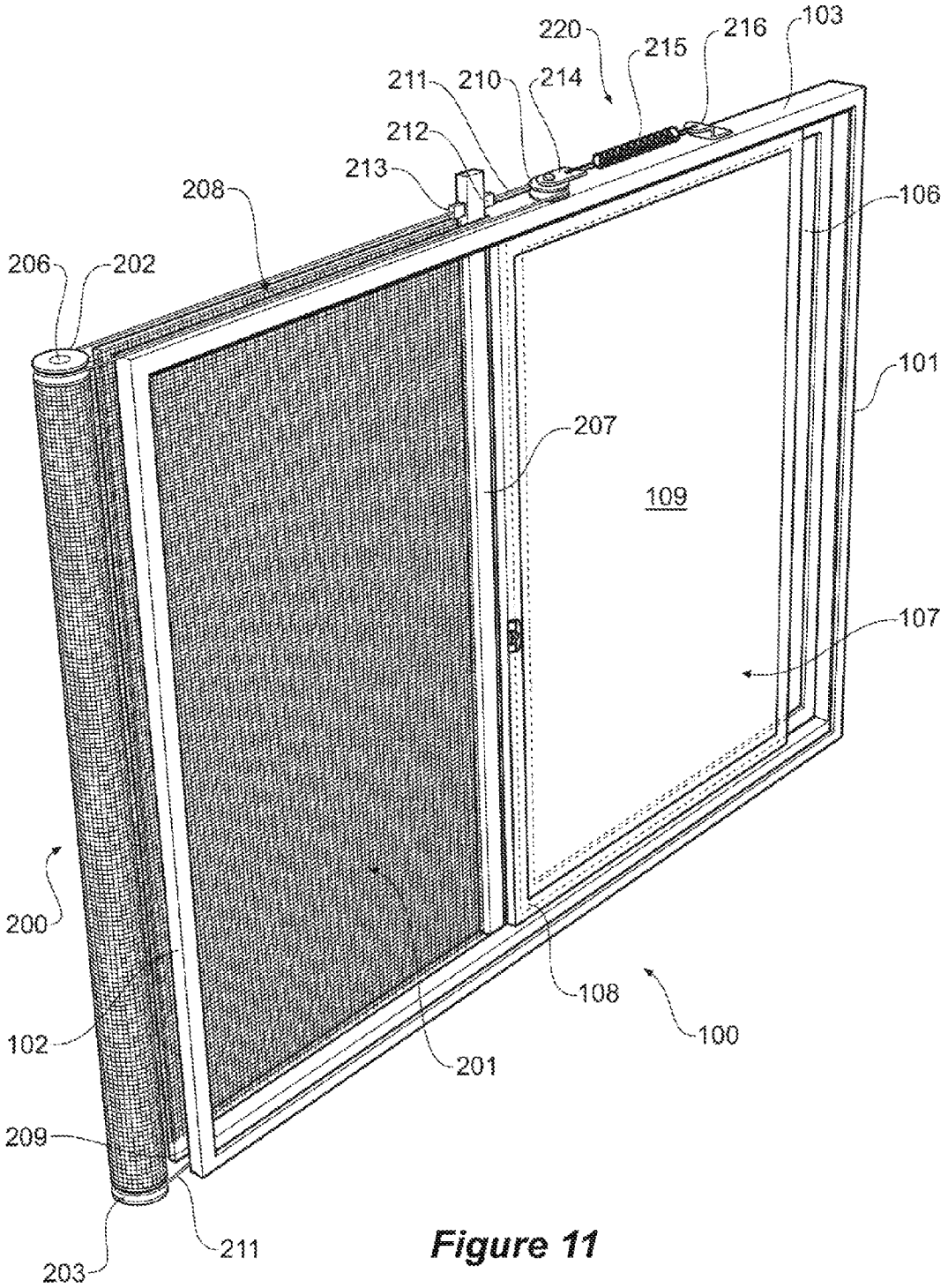
FIG. 11 shows an assembled view of a roller assembly with an alternative operative means to rotate the roller.
Figure 12:
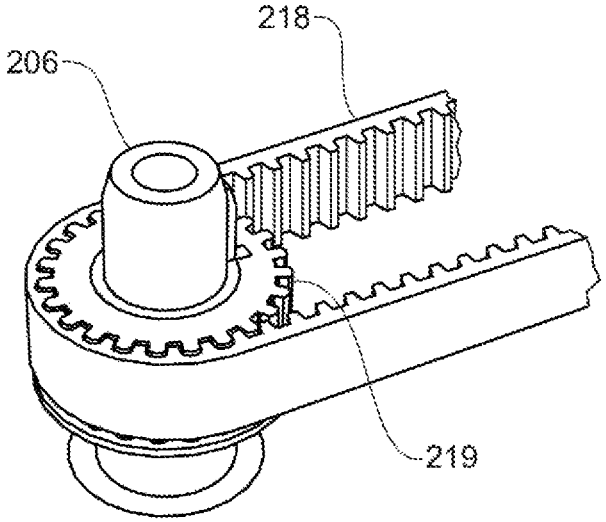
FIG. 12 shows a toothed belt used in conjunction with a tooth pulley for rotating the spindle.

The above embodiments utilise an operative member in the form of a cord that is anchored at one end 212 to the post 207 or proximal end of the window panel at anchor point, and at the other end to the spindle pulley 202. The operative member is looped around an idler pulley 210. In the above embodiment, the idler pulley is part of a tension adjustment arrangement 220 that adjusts the location of the idler pulley 210 to compensate for changes in the tension of the operative member as the window is opened and closed. In another embodiment, the location of the idler pulley 210 is fixed and the tension adjustment arrangement is omitted. A further alternative embodiment is shown in FIGS. 11 and 12 in which the cord 211 is replaced with a loop. As shown in FIG. 11, the cord 211 is secured at its first end 212 to the post 207, is then located around the idler pulley 210 and is then wrapped around the pulleys 202 and 203 at least once before returning to be secured at its second end 213 to the post 207. In this case, both opening and closing of the window panel 107 rotates the pulleys 202 and 203. This arrangement requires a good grip between the cord 211 and the pulleys 202 and 203 in order to avoid any slippage. In order to prevent slippage a tooth belt 218 can be used instead of cord 211, and a tooth pulley 219 can be secured to the spindle 206. An embodiment of a tooth belt 218 and tooth pulley are illustrated in FIG. 12. In these embodiments the tension adjustment arrangement can be omitted.

Although the above embodiments shown in the Figures have a horizontally sliding window panel, the invention will be equally suited to window panels that slide vertically, such as in the case of sash windows. This is equivalent to rotating the frame ±90°, and thus the mechanism is the same, with the definition of side members and upper and lower frame members exchanged accordingly. In addition, in the above embodiments only one idler pulley 210 and roller assembly pulley 202 at either the top edge or the bottom edge of the window frame 101 may be utilised. Further, the invention would be equally suited to window frames that have a pair of moving window panels 107 located on each side of a large window frame 100. Further, the system could be further adapted for use with two sliding windows that slide over each other rather than a fixed and sliding window arrangement. In this embodiment, each window would have its own cord and tension adjustment arrangement, and these would be vertically offset (i.e. vertically stacked) in order to prevent interference. Further, the window panes could instead be solid or opaque panels. It will also be understood that they system could also be used with sliding door arrangements. Other embodiments are also possible.

In other embodiments, the screen 201 or the post 207 maybe readily detachable from the window panel 107 so that the window panel 107 can be opened without the screen being in place. The screen 201 may be a mesh screen such as a fly screen, or it may be an opaque or semi-transparent air permeable material to provide a light block out function whilst permitting at least some air flow. Further, brush or felt strips maybe used in a conventional way to form a seal between the window panel 107 and the first pane of glass 106. In addition, the slots 208 may be provided with brush or felt strips which act to from an air resistant seal at the edges of the screen 201.

As will be seen from the above description the invention provides a novel means of moving the screen with respect to a moving panel. The advantage of the roller assembly 200 is that is does not require any form of spring based tensioning arrangements to rewind the screen 201 onto the roller assembly 200. When the window panel 107 is closed, the screen 201 is fully retracted so that is does not obstruct the view to any extent when the window panel 107 is in its closed position.

The screen system described herein provides several advantages over existing screening systems. Notably the screen system uses a roller assembly comprising a screen wound onto a spindle. Thus, when the window is closed and the screen is not required the screen is hidden or integrated into the window frame. Further, the mechanism used for extending and retracting the screen does not require any form of spring based tensioning arrangements to rewind the screen onto the roller assembly. Instead, the arrangement guides an operative member around a pulley provided with a tension adjustment arrangement. This provides a smooth mechanism to extend and retract the screen. When the window panel is open and thus the screen is an extended position, closing the window is translated into a pulling action on the cord to unwind the cord off the first pulley, and this drives the rotation of the spindle to wind the screen back an. Conversely, opening the window to extend the screen rotates the spindle and pulley to wind the cord back onto the first pulley. Further, the roller assembly and guide assembly are relatively compact, allowing the frame to have a low thickness/profile. Additionally, the window frame members use clip in covers, and the roller assembly is designed to removably clip into the side frame member in which it is housed.

Throughout the specification and the claims that follow, unless the context requires otherwise, the words "comprise" and "include" and variations such as "comprising" and "including" will be understood to imply the inclusion of a stated integer or group of integers, but not the exclusion of any other integer or group of integers.

The reference to any prior art in this specification is not, and should not be taken as, an acknowledgement of any form of suggestion that such prior art forms part of the common general knowledge.

It will be appreciated by those skilled in the art that the invention is not restricted in its use to the particular application described. Neither is the present invention restricted in its preferred embodiment with regard to the particular elements and/or features described or depicted herein. It will be appreciated that the invention is not limited to the embodiment or embodiments disclosed, but is capable of numerous rearrangements, modifications and substitutions without departing from the scope of the invention as set forth and defined by the following claims.

The invention claimed is:

1. A screen system for use with a sliding panel of a window or door to screen an opening as the sliding panel or door is opened, the system comprising:

a frame, a sliding panel housed within the frame and comprising a first edge, wherein the sliding panel is slideable between a closed position and an open position to define an opening adjacent the first edge;

a roller assembly comprising: a screen attached to the first edge of the sliding panel; a spindle around which the screen is wound and rotatably mounted adjacent the first edge when the sliding panel is in the closed position so that the screen can be unwound from the spindle as the sliding panel is opened, and wound back onto the spindle as the sliding panel is closing; and a spindle rotation assembly for rotating the spindle;

an idler pulley located within the frame;

at least one operative means connected between the sliding panel and the spindle rotation assembly via the idler pulley, that causes the spindle to rotate so as to wind the screen back onto the spindle as the sliding panel is closing; and a tension adjustment arrangement comprising a mount housing that houses the idler pulley, a spring anchor securable with respect to the frame, and a spring secured between the mount housing and the spring anchor wherein the tension adjustment arrangement is configured to adjust the tension in the operative means as the screen is wound and unwound from the spindle, wherein the frame comprises an upper slot, and the tension adjustment arrangement is located and secured in the upper slot, and the upper slot comprises two side walls and the spring anchor is a block with tapered sides, and the tension adjustment further comprises a U shaped receiving block that is fastened to the spring anchor so that the tapered sides of the spring anchor force the walls of the U shaped receiving block outwards to generate an interference fit with the two side walls of the upper slot to secure the spring anchor in the upper slot;

wherein the frame comprises a side frame member that substantially houses the roller assembly, and the side frame member has a removable cover, and the spindle comprises a rod portion onto which the screen is wound, and a retractable assembly having an extended configuration and a retracted configuration, such that the length of the spindle in the retracted configuration is less than the length of the spindle in the extended configuration to allow removal of the spindle from the side frame member; and wherein the retractable assembly comprises a tube, a spring, a barrel and a plug, the tube comprising an open end for receiving the spring and barrel, and the barrel comprises a barrel lock aperture for receiving the plug, and a barrel projection, and the tube comprises a first cut out portion aligned with the barrel lock aperture, and second cut-out portion aligned with the barrel projection, such that when the plug is inserted through the first cut-out portion and into the barrel lock aperture, an end of the barrel extends beyond the second end of the tube and the retractable assembly is locked in the extended configuration, and when the plug is removed, the barrel can be at least partially retracted into the tube.

2. The screen system as claimed in claim 1, wherein the spindle rotation assembly comprises a spindle pulley axially mounted to one end of the spindle.

3. A screen system for use with a sliding panel of a window or door to screen an opening as the sliding panel or door is opened, the system comprising:

a frame, a sliding panel housed within the frame and comprising a first edge, wherein the sliding panel is slideable between a closed position and an open position to define an opening adjacent the first edge;

a roller assembly comprising: a screen attached to the first edge of the sliding panel; a spindle around which the screen is wound and rotatably mounted adjacent the first edge when the sliding panel is in the closed position so that the screen can be unwound from the spindle as the sliding panel is opened, and wound back onto the spindle as the sliding panel is closing; and a spindle rotation assembly for rotating the spindle;

an idler pulley located within the frame;

at least one operative means connected between the sliding panel and the spindle rotation assembly via the idler pulley, that causes the spindle to rotate so as to wind the screen back onto the spindle as the sliding panel is closing; and a tension adjustment arrangement comprising a mount housing that houses the idler pulley, a spring anchor securable with respect to the frame, and a spring secured between the mount housing and the spring anchor wherein the tension adjustment arrangement is configured to adjust the tension in the operative means as the screen is wound and unwound from the spindle, wherein the frame comprises an upper slot, and the tension adjustment arrangement is located and secured in the upper slot, and the upper slot comprises two side walls and the spring anchor is a block with tapered sides, and the tension adjustment further comprises a U shaped receiving block that is fastened to the spring anchor so that the tapered sides of the spring anchor force the walls of the U shaped receiving block outwards to generate an interference fit with the two side walls of the upper slot to secure the spring anchor in the upper slot;

wherein the spindle rotation assembly comprises a spindle pulley axially mounted to one end of the spindle; and wherein spindle pulley comprises an axial aperture, and the spindle rotation assembly rotatably mounts the spindle and comprises a mounting block with a front face that faces the first edge of the sliding panel, a curved cut-out portion for receiving the spindle pulley, an axial projection located within the curved cut-out portion which in use projects into the axial aperture of the spindle pulley, and a channel from the front face to the curved cut-out portion to guide the operative means onto the spindle pulley.

4. The screen system as claimed in claim 3, wherein the top surface of the mounting block comprises a flange and a channel, and the mounting block is supported by a top frame member of the frame that comprises a slot for receiving the flange and a pair of projections that are received in the channel.

5. The screen system as claimed in claim 3, wherein the screen is removably attached to the first edge.

6. The screen system as claimed in claim 3, wherein the frame comprises a first side frame member, a second side frame member, and upper frame member and a lower frame member, and each of the frame members are extrusions, wherein the upper frame member comprises an upper slot, and the lower frame member comprises a lower slot wherein the upper slot and lower slot are aligned and the sliding panel slides within the upper slot and the lower slot, and the roller assembly is substantially housed within the second side frame member and comprises a screen aperture through which the screen is unwound and wound onto the spindle, and a screen guide extending from the upper slot to the lower slot to guide the screen onto and off the spindle.

7. The screen system as claimed in claim 3, wherein the spindle rotation assembly further comprises a guide roller, and the channel comprises a straight portion and an angled portion, wherein the guide roller is located at the junction of the straight portion and angled portion and partially projects into the channel to guide the operative means as it is wound and unwound from the spindle pulley.

8. The screen system as claimed in claim 7, wherein the top surface of the mounting block comprises a flange and a channel, and the mounting block is supported by a top frame member of the frame that comprises a slot for receiving the flange and a pair of projections that are received in the channel.

9. A screen system for use with a sliding panel of a window or door to screen an opening as the sliding panel or door is opened, the system comprising:

a frame, a sliding panel housed within the frame and comprising a first edge, wherein the sliding panel is slideable between a closed position and an open position to define an opening adjacent the first edge;

a roller assembly comprising: a screen attached to the first edge of the sliding panel; a spindle around which the screen is wound and rotatably mounted adjacent the first edge when the sliding panel is in the closed position so that the screen can be unwound from the spindle as the sliding panel is opened, and wound back onto the spindle as the sliding panel is closing; and a spindle mounting assembly to rotatably mount the spindle;

an idler pulley located within the frame;

a linkage connected between the sliding panel and the spindle mounting assembly via the idler pulley, that causes the spindle to rotate so as to wind the screen back onto the spindle as the sliding panel is closing; and a tension adjustment arrangement comprising a mount housing that houses the idler pulley, a spring anchor securable with respect to the frame, and a spring secured between the mount housing and the spring anchor wherein the tension adjustment arrangement is configured to adjust the tension in the linkage as the screen is wound and unwound from the spindle, wherein the frame comprises an upper slot, and the tension adjustment arrangement is located and secured in the upper slot, and the upper slot comprises two side walls and the spring anchor is a block with tapered sides, and the tension adjustment further comprises a U shaped receiving block that is fastened to the spring anchor so that the tapered sides of the spring anchor force the walls of the U shaped receiving block outwards to generate an interference fit with the two side walls of the upper slot to secure the spring anchor in the upper slot;

wherein the frame comprises a side frame member that substantially houses the roller assembly, and the side frame member has a removable cover, and the spindle comprises a rod portion onto which the screen is wound, and a retractable assembly having an extended configuration and a retracted configuration, such that the length of the spindle in the retracted configuration is less than the length of the spindle in the extended configuration to allow removal of the spindle from the side frame member; and wherein the retractable assembly comprises a tube, a spring, a barrel and a plug, the tube comprising an open end for receiving the spring and barrel, and the barrel comprises a barrel lock aperture for receiving the plug, and a barrel projection, and the tube comprises a first cut out portion aligned with the barrel lock aperture, and second cut-out portion aligned with the barrel projection, such that when the plug is inserted through the first cut-out portion and into the barrel lock aperture, an end of the barrel extends beyond the second end of the tube and the retractable assembly is locked in the extended configuration, and when the plug is removed, the barrel can be at least partially retracted into the tube.

10. A screen system for use with a sliding panel of a window or door to screen an opening as the sliding panel or door is opened, the system comprising:

a frame, a sliding panel housed within the frame and comprising a first edge, wherein the sliding panel is slideable between a closed position and an open position to define an opening adjacent the first edge;

a roller assembly comprising: a screen attached to the first edge of the sliding panel; a spindle around which the screen is wound and rotatably mounted adjacent the first edge when the sliding panel is in the closed position so that the screen can be unwound from the spindle as the sliding panel is opened, and wound back onto the spindle as the sliding panel is closing; and a spindle mounting assembly to rotatably mount the spindle;

an idler pulley located within the frame;

a linkage connected between the sliding panel and the spindle mounting assembly via the idler pulley, that causes the spindle to rotate so as to wind the screen back onto the spindle as the sliding panel is closing; and a tension adjustment arrangement comprising a mount housing that houses the idler pulley, a spring anchor securable with respect to the frame, and a spring secured between the mount housing and the spring anchor wherein the tension adjustment arrangement is configured to adjust the tension in the linkage as the screen is wound and unwound from the spindle, wherein the frame comprises an upper slot, and the tension adjustment arrangement is located and secured in the upper slot, and the upper slot comprises two side walls and the spring anchor is a block with tapered sides, and the tension adjustment further comprises a U shaped receiving block that is fastened to the spring anchor so that the tapered sides of the spring anchor force the walls of the U shaped receiving block outwards to generate an interference fit with the two side walls of the upper slot to secure the spring anchor in the upper slot;

wherein the spindle mounting assembly comprises a spindle pulley axially mounted to one end of the spindle; and wherein spindle pulley comprises an axial aperture, and the spindle mounting assembly rotatably mounts the spindle and comprises a mounting block with a front face that faces the first edge of the sliding panel, a curved cut-out portion for receiving the spindle pulley, an axial projection located within the curved cut-out portion which in use projects into the axial aperture of the spindle pulley, and a channel from the front face to the curved cut-out portion to guide the operative means onto the spindle pulley.

* * * * *